US006713960B2

(12) United States Patent
Hirose

(10) Patent No.: US 6,713,960 B2
(45) Date of Patent: Mar. 30, 2004

(54) PLASMA DISPLAY PANEL AND PLASMA DISPLAY DEVICE

(75) Inventor: Katsuhiro Hirose, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/867,605

(22) Filed: May 31, 2001

(65) Prior Publication Data

US 2001/0050533 A1 Dec. 13, 2001

(30) Foreign Application Priority Data

May 31, 2000 (JP) ..... P2000-161730
Feb. 8, 2001 (JP) ..... P2001-031994

(51) Int. Cl.[7] ..... H01J 17/49
(52) U.S. Cl. ..... 313/583; 313/582; 313/585
(58) Field of Search ..... 313/583, 584, 313/585, 586, 582

(56) References Cited

U.S. PATENT DOCUMENTS 4,737,687 A * 4/1988 Shinoda et al. ..... 315/169.4
6,157,128 A * 12/2000 Namiki et al. ..... 313/581
6,172,461 B1 * 1/2001 Ha ..... 313/585
6,353,292 B1 * 3/2002 Takamori et al. ..... 315/169.4
6,452,333 B1 * 9/2002 Torisaki et al. ..... 313/586

FOREIGN PATENT DOCUMENTS

| | | |
|---|---|---|
| JP | A822772 | 1/1996 |
| JP | 10-092326 | 4/1998 |
| JP | A10308179 | 11/1998 |

* cited by examiner

*Primary Examiner*—Vip Patel
*Assistant Examiner*—Jason Phinney
(74) *Attorney, Agent, or Firm*—Birch, Stewart, Kolasch & Birch, LLP

(57) ABSTRACT

In a scan electrode (2), the widths of transparent electrodes (2*b*) vary depending on colors so that the relation of the widths (WR0, WG1, WB1) of the transparent electrodes (2*b*R, 2*b*G, 2*b*B) in the Y direction may become WB1>WR0>WG1. Similarly, in a sustain electrode (3), the widths of transparent electrodes (3*b*) vary depending on colors so that the relation of the widths (WR0, WG1, WB1) of the transparent electrodes (3*b*R, 3*b*G, 3*b*B) in the Y direction may become WB1>WR0>WG1. With this variation in width, a plasma display panel capable of setting the color temperature of white to a proper value can be obtained without control of input gains which would invite deterioration in the number of tones.

10 Claims, 16 Drawing Sheets

PLASMA DISPLAY PANEL AND PLASMA DISPLAY DEVICE

BACKGROUND OF THE INVENTION

1. Field of the Invention

The present invention relates to a structure of an AC surface discharge type color plasma display panel of matrix display and a plasma display device comprising the plasma display panel (hereinafter referred to as "PDP").

2. Description of the Background Art

FIG. 13 is a perspective view showing a cell structure of an AC surface discharge type PDP. FIG. 14 is a schematic view showing an arrangement of a scan electrode 102, a sustain electrode 103 and barrier ribs 108 viewed from the X direction shown in FIG. 13. In general, an AC surface discharge type PDP of matrix display consists of a front panel on the side of display surface and a rear panel opposed to the front panel with a discharge space interposed therebetween. On a main surface of a glass substrate 101 in the front panel (a surface on the side opposed to the rear panel), a plurality of pairs of scan electrodes 102 and sustain electrodes 103 (only a pair is shown in FIGS. 13 and 14) are each arranged parallelly and symmetrically with a discharge gap which is a core of discharge in each discharge cell interposed therebetween with a spacing of pixel pitch in the Z direction of these figures.

Referring to FIG. 14, the scan electrode 102 is constituted of a bus electrode 102*a* which extends in the Y direction of the figure and transparent electrodes 102*b* (102*b*R1, 102*b*G, 102*b*B and 102*b*R2 in FIG. 14) which are connected to the bus electrode 102*a* and protrude in the Z direction of the figure. Further, the sustain electrode 103 is constituted of a bus electrode 103*a* which extends in the Y direction and transparent electrodes 103*b* (103*b*R1, 103*b*G, 103*b*B and 103*b*R2 in FIG. 14) which are connected to the bus electrode 103*a* and protrude in the Z direction to define the discharge gaps between themselves and the transparent electrodes 102*b*. The lengths of the transparent electrodes 102*b* and 103*b* (L102*b*0 and L103*b*0) in the Z direction are equal and the widths thereof (WR0, WG0 and WB0) in the Y direction are equal among all the discharge cells. Further, the spacings (G0) of the discharge gaps in the Z direction are equal among all the discharge cells.

The transparent electrodes 102*b* and 103*b* are made of materials having a relatively high transmissivity of visible rays, such as ITO (Indium Tin Oxide) or $SnO_2$ (NESA), and formed by thin film processing such as evaporation or CVD in many cases. Further, the bus electrodes 102*a* and 103*a* are made of materials having relatively low resistance, such as silver, aluminum, copper or multilayer film of chromium and copper, and formed by thick film processing using printing process or thin film processing using photosensitive paste.

Furthermore, on the main surface of the glass substrate 101, a dielectric layer 104 is formed covering the scan electrode 102 and the sustain electrode 103. A surface of the dielectric layer 104 (exposed to the discharge space) is covered with a protection film 105 made of MgO and the like having relatively high secondary emission ratio and excellent sputtering resistance against ions, electrons and the like generated from the discharge.

On a main surface of a glass substrate 106 in the rear panel (a surface on the side opposed to the front panel), a plurality of barrier ribs 108 having a predetermined height are formed extending in the Z direction between adjacent discharge cells in the Y direction, to define a discharge space between the front panel and the rear panel. Further, on the main surface of the glass substrate 106, a plurality of write electrodes 107 (107R, 107G and 107B in FIG. 13) are formed extending in the Z direction between the adjacent barrier ribs 108.

On a surface of a concave portion made by side surfaces of the barrier ribs 108 and the main surface of the glass substrate 106, predetermined phosphors 109 (109R, 109G and 109B in FIG. 13) corresponding to red (R), green (G) and blue (B), respectively, are coated, to cover the write electrodes 107. Further, in some times, an insulating layer is provided between the write electrode 107 and the phosphor 109.

The front panel and the rear panel are sealed to each other by a sealing member (not shown) provided on rims of the panels, bringing tops of the barrier ribs 108 and the protection film 105 into contact with each other. The discharge space of the PDP formed by the front panel, the rear panel and the sealing member and defined by the barrier ribs 108 is filled with a noble gas such as xenon which generates ultraviolet ray from a discharge and a dischargeable gas such as nitrogen or oxygen. The phosphors 109 are excited by the ultraviolet ray generated from the discharge to cause luminescence in respective colors.

FIG. 15 is a schematic view briefly illustrating a process for luminescence of the discharge cell in the background-art PDP. In the discharge cell to be lighted, a predetermined voltage is applied between the scan electrode 102 and the write electrode 107 to cause a discharge between these electrodes. This is termed writing discharge, and positive ions and electrons ionized by the writing discharge are accumulated as wall charges on surfaces of the phosphors 109 and the protection film 105.

In the discharge cell in which the wall charges are accumulated, when a voltage is applied to the sustain electrode 103, a creepage discharge starts through the discharge gap between the scan electrode 102 and the sustain electrode 103. After that, an alternating electric field is further produced in the scan electrode 102 and the sustain electrode 103, and a discharge is thereby repeatedly caused in the scan electrode 102 and the sustain electrode 103. This discharge, repeatedly occurring in the scan electrode 102 and the sustain electrode 103, is termed sustain discharge, and the ultraviolet rays generated from the sustain discharge excites the phosphors 109 and becomes visible rays to be radiated outside through the front panel.

In order to make a tone display in the PDP, generally adopted is the time division toning system in which the number of sustain discharges in one field period of an image is controlled to control the luminance. One field period is divided into some small time units called subfields (SF), and pulse voltages to cause the sustain discharge, the number of which is weighted on the binary basis, are inserted in each subfield. For example, when one field is divided into eight subfields (SF0 to SF7) and sustain pulses are inserted in the respective subfields at a ratio of 1:2:4:8:16:32:64:128, combination of any subfields allows representation of 256-level luminance. Such a control is made on the discharge cells for all the colors, to represent about 16,700,000 colors.

If white is displayed by using the PDP which adopts this time division toning system, when gains of respective input signals of red, green and blue are mixed at a ratio of 1:1:1, 256-level white can be displayed. When all the colors are displayed by the maximum gains, in particular, white of maximum luminance can be displayed theoretically. Herein, white refers to a color whose normal state is at a point of color temperature of 6500 K in the Planckian locus of CIE xy chromaticity diagram.

When white is actually displayed in the PDP, however, even if the phosphors 109R, 109G and 109B are irradiated with the same amount of ultraviolet rays at a mixture ratio of 1:1:1, white can not be displayed or the color temperature is lowered in some cases. These phenomena are caused by bad balance of obtained visible lights of colors or affected by the visible lights of discharge gas itself other than the those from the phosphors 109. Particularly, low color temperature is largely affected by luminescence characteristics of the blue phosphor 109B. For this reason, when white is displayed in the PDP, the gains of the input signals are controlled, with the gains for red and green made lower than that for blue. For example, the gains for red, green and blue are controlled as R:G:B=0.8:0.5:1, to display white of desired color temperature.

With the above control of input gains, however, 256-level tone display can not be achieved on red or green. In the PDP displaying 256-level tone for each color (16,700,000 colors), for example, when the respective input gains for the colors are controlled as R:G:B=0.8:0.5:1, the respective tones for red and green are lowered to 256×0.8=204-level tone and 256×0.5=128-level tone, relative to 256-level tone for blue, and the quality of tone display is markedly deteriorated.

An invention intended to set the color temperature of white to a proper value without controlling the input gains, in which the luminescence areas of the phosphors are varied depending on colors by varying the widths of the phosphors, is disclosed in Japanese Patent Application Laid-Open No. 10-308179 (1998). In the invention shown in the gazette, however, varying the widths of the phosphors causes variation in voltage margin of the discharge cells, leading to wrong discharge.

SUMMARY OF THE INVENTION

The present invention is directed to a plasma display panel. According to a first aspect of the present invention, the plasma display panel comprises: a first substrate serving as a display surface; a second substrate opposed to the first substrate with a discharge space interposed therebetween, the discharge space consisting of a plurality of unit discharge regions arranged in matrix; a first electrode and a second electrode formed on a main surface of the first substrate on the side of the discharge space, being paired with each other and provided for each row of the plurality of unit discharge regions; a third electrode formed on a main surface of the second substrate on the side of discharge space, being provided for each column of the plurality of unit discharge regions; and phosphors of two kinds or more formed on the main surface of the second substrate covering the third electrode, having different luminescent colors, and in the plasma display panel of the first aspect, the first electrode has a trunk portion extending in a first direction which is a direction of the row; and branch portions connected to the trunk portion, being provided for the plurality of unit discharge regions, respectively, and protruding in a second direction which is a direction of the column, the second electrode has a trunk portion extending in the first direction; and branch portions connected to the trunk portion of the second electrode, being provided for the plurality of unit discharge regions, respectively, and protruding in the second direction to define discharge gaps between the branch portions of the first and second electrodes, respectively, and the areas of the branch portions of at least one of the first electrode and the second electrode vary among the plurality of unit discharge regions, depending on the luminescent colors.

According to a second aspect of the present invention, in the plasma display panel of the first aspect, the widths of the branch portions of at least one of the first electrode and the second electrode in the first direction vary among the plurality of unit discharge regions, depending on the luminescent colors.

According to a third aspect of the present invention, in the plasma display panel of the first or second aspect, the lengths of the branch portions of at least one of the first electrode and the second electrode in the second direction vary among the plurality of unit discharge regions, depending on the luminescent colors.

According to a fourth aspect of the present invention, in the plasma display panel of the third aspect, the lengths of the branch portions of the first electrode in the second direction vary among the plurality of unit discharge regions, and the trunk portion of the first electrode is arranged on an end portion of one of the branch portions which has the shortest length in the second direction on the side opposite to corresponding one of the discharge gaps.

According to a fifth aspect of the present invention, in the plasma display panel of any one of the first to fourth aspects, the spacings of the discharge gaps in the second direction vary among the plurality of unit discharge regions, depending on the luminescent colors.

According to a sixth aspect of the present invention, in the plasma display panel of any one of the first to fifth aspects, the areas of the branch portions of either one of the first electrode and the second electrode vary among the plurality of unit discharge regions.

According to a seventh aspect of the present invention, in the plasma display panel of the sixth aspect, the trunk portion of the first electrode and the branch portions of the first electrode are formed of the same material as a unit.

According to an eighth aspect of the present invention, in the plasma display panel of any one of the first to seventh aspects, the branch portions of the first electrode are frame-like metal electrodes having the same shape as rims of the branch portions.

According to a ninth aspect of the present invention, in the plasma display panel of the eighth aspect, the trunk portion of the first electrode is a metal electrode, and the trunk portion of the first electrode and the branch portions of the first electrode are formed as a unit.

According to a tenth aspect of the present invention, in the plasma display panel of the ninth aspect, the trunk portion of the first electrode is formed only outside the rims of the branch portions of the first electrode.

According to an eleventh aspect of the present invention, the plasma display panel comprises: a first substrate serving as a display surface; a second substrate opposed to the first substrate with a discharge space interposed therebetween, the discharge space consisting of a plurality of unit discharge regions arranged in matrix; a first electrode and a second electrode formed on a main surface of the first substrate on the side of the discharge space, being paired with each other and provided for each row of the plurality of unit discharge regions; a third electrode formed on a main surface of the second substrate on the side of discharge space, being provided for each column of the plurality of unit discharge regions; and phosphors of two kinds or more formed on the main surface of the second substrate covering the third electrode, having different luminescent colors, and in the plasma display panel of the fifth aspect, the first electrode has a trunk portion extending in a first direction which is a direction of the row; and branch portions connected to the trunk portion, being provided for the plurality of unit discharge regions, respectively, and protruding in a second direction which is a direction of the column, the second electrode has a trunk portion extending in the first direction; and branch portions connected to the trunk portion of the second electrode, being provided for the plurality of unit discharge regions, respectively, and protruding in the second direction to define discharge gaps between the branch portions of the first and second electrodes, respectively, and the spacings of the discharge gaps in the second direction vary among the plurality of unit discharge regions, depending on the luminescent colors.

According to a twelfth aspect of the present invention, in the plasma display panel of any one of the first to eleventh aspects further comprises a dielectric layer formed on the main surface of the first substrate covering the first electrode and the second electrode, and in the plasma display panel of the sixth aspect, the phosphors are also formed on a surface of the dielectric layer in portions which do not overlap neither the branch portions of the first electrode nor the branch portions of the second electrode in plan view.

The present invention is also directed to a plasma display device. According to a thirteenth aspect of the present invention, the plasma display device comprises: the plasma display panel of any one of the first to twelfth aspects; and a driving circuit for driving the plasma display panel.

In the plasma display panel of the first aspect of the present invention, by varying the areas of the branch portions of the first electrode, the amounts of ultraviolet rays to be irradiated on the phosphors can be varied depending on colors. Therefore, by increasing the area of the branch portion of the first electrode as the luminescence intensity in the unit discharge region becomes smaller in irradiation of the same amount of ultraviolet rays, it is possible to uniformize the luminescence intensities among the unit discharge regions for all the colors.

In the plasma display panel of the second aspect of the present invention, by varying the widths of the branch portions in the first direction, the area of branch portions of the first electrode can be varied depending on colors.

In the plasma display panel of the third aspect of the present invention, by varying the lengths of the branch portions in the second direction, the area of branch portions of the first electrode can be varied depending on colors. Moreover, it is possible to ensure sufficient allowance of misalignment in bonding the first substrate and the second substrate for all the luminescent colors.

In the plasma display panel of the fourth aspect of the present invention, decrease in the luminescence intensity of the plasma display panel caused by the branch portions of the first electrode can be minimized.

In the plasma display panel of the fifth aspect of the present invention, by varying the spacings of the discharge gaps in the second direction, the incidence of the sustain discharges can be varied depending on colors. Therefore, by setting so that the spacing of the discharge gap in the second direction may become narrower as the firing voltage of the writing discharge in the unit discharge region becomes higher, it is possible to uniformize the incidence of the sustain discharges among the unit discharge regions for all the colors.

In the plasma display panel of the sixth aspect of the present invention, after forming the first or second electrode having the branch portions whose areas are not varied thereamong and aligning with the first or second electrode, the second or first electrode having the branch portions whose areas are varied thereamong can be formed. Therefore, the first and second electrodes can be manufactured with relatively high precision.

In the plasma display panel of the seventh aspect of the present invention, as compared with the first electrode having the trunk portion and the branch portions individually formed of the different materials, it is relatively easy to manufacture the first electrode.

In the plasma display panel of the eighth aspect of the present invention, even when the branch portions of the first electrode are formed of a material having low transmissivity, decrease in the luminescence intensity of the plasma display panel can be controlled.

In the plasma display panel of the ninth aspect of the present invention, it is not required to form the trunk portion of the first electrode by aligning the trunk portion with predetermined portions on the branch portions of the first electrode. Therefore, manufacture process can be simplified.

In the plasma display panel of the tenth aspect of the present invention, the trunk portion of the first electrode is not formed in portions inside the rims of the branch portions of the first electrode. Therefore, decrease in the luminescence intensity of the plasma display panel can be further controlled.

In the plasma display panel of the eleventh aspect of the present invention, by varying the spacings of the discharge gaps in the second direction, the incidence of the sustain discharges can be varied depending on colors. Therefore, by setting the spacing of the discharge gap in the second direction as to become narrower as the firing voltage of the writing discharge in the unit discharge region becomes higher, it is possible to uniformize the incidence of the sustain discharges among the unit discharge regions for all the colors.

In the plasma display panel of the twelfth aspect of the present invention, since the phosphors are formed not only on the side of the second substrate but also on the side of the first substrate serving as a display surface, it is possible to enhance the luminance of the plasma display panel.

In the plasma display device of the thirteenth aspect of the present invention, it is possible to provide a plasma display device having excellent display characteristics.

An object of the present invention is to provide a plasma display panel capable of setting the color temperature of white to a proper value without control of the input gains which causes deterioration in the number of tones, not accompanied by wrong discharge, and a plasma display device comprising the plasma display panel.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
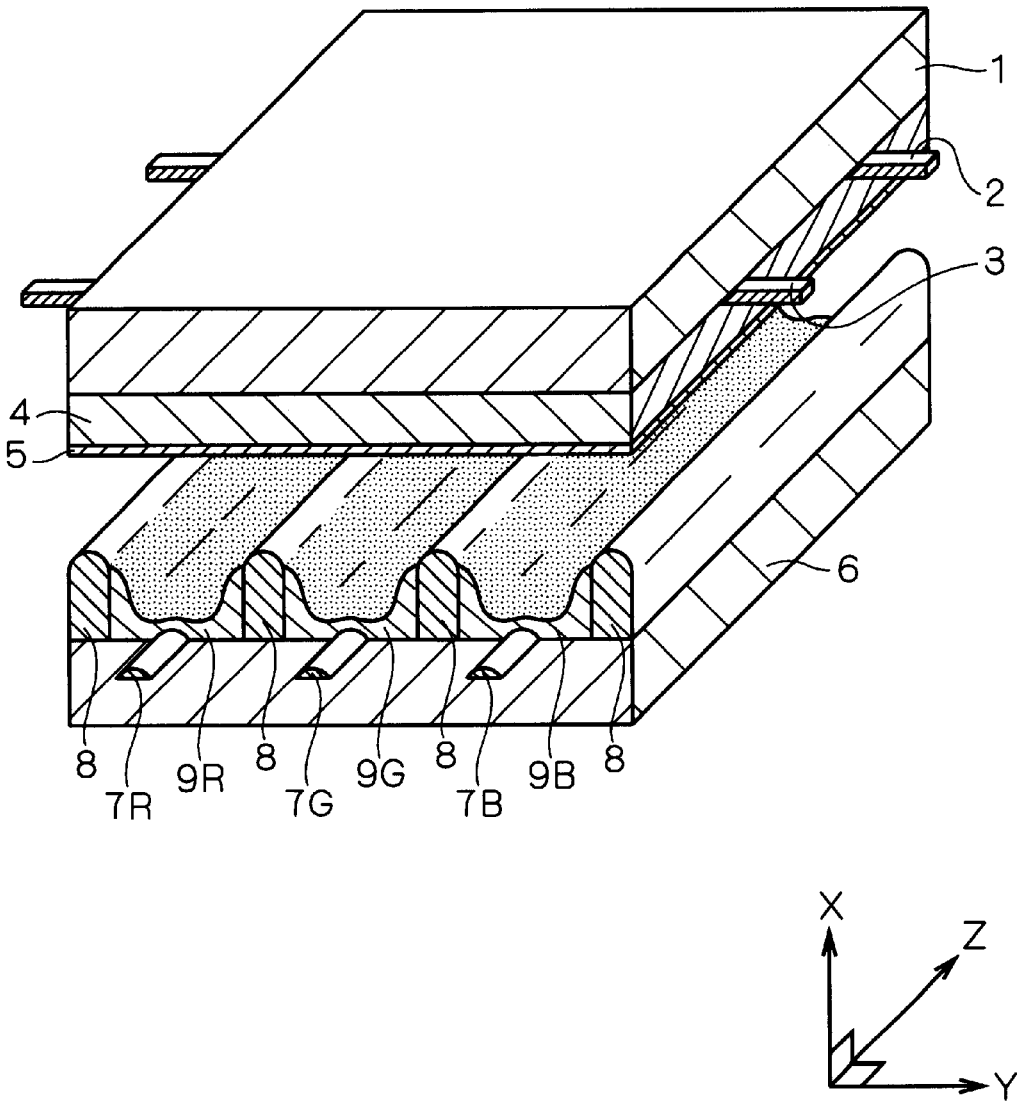
FIG. 1 is a perspective view showing a cell structure of a PDP.

FIG. 1 is a perspective view showing a cell structure of a PDP. Though FIG. 1 shows the cell structure for one pixel, actually in the PDP, a plurality of discharge cells in accordance with the number of pixels are arranged in matrix, constituting a discharge cell matrix. As shown in FIG. 1, the PDP in accordance with the present invention comprises a front panel and a rear panel which are opposed to each other with a discharge space interposed therebetween. The front panel has a glass substrate 1 serving as a display surface, a scan electrode 2 and a sustain electrode 3 which are paired with a spacing therebetween, both extending in the Y direction of the figure on a main surface of the glass substrate 1 (a surface on the side opposed to a glass substrate 6) and a dielectric layer 4 formed on the main surface of the glass substrate 1 covering the scan electrode 2 and the sustain electrode 3. On a surface of the dielectric layer 4 (exposed to the discharge space) formed is a protection film 5 made of MgO and the like.

Further, the rear panel has the glass substrate 6, write electrodes 7 (7R, 7G and 7B in FIG. 1) formed on a main surface of the glass substrate 6 (a surface on the side opposed to the glass substrate 1) extending in the Z direction of the figure, barrier ribs 8 formed extending in the Z direction between the adjacent write electrodes 7 on the main surface of the glass substrate 6 and predetermined phosphors 9 (9R, 9G and 9B of FIG. 1) corresponding to red, green and blue, each of which is coated on a surface of a concave portion made by side surfaces of the barrier ribs 8 and the main surface of the glass substrate 6.

The present invention relates to the structure of the front panel, particularly to the structure of the scan electrode 2 and the sustain electrode 3. The preferred embodiments of the present invention will be specifically discussed below.

The First Preferred Embodiment

Figure 2:
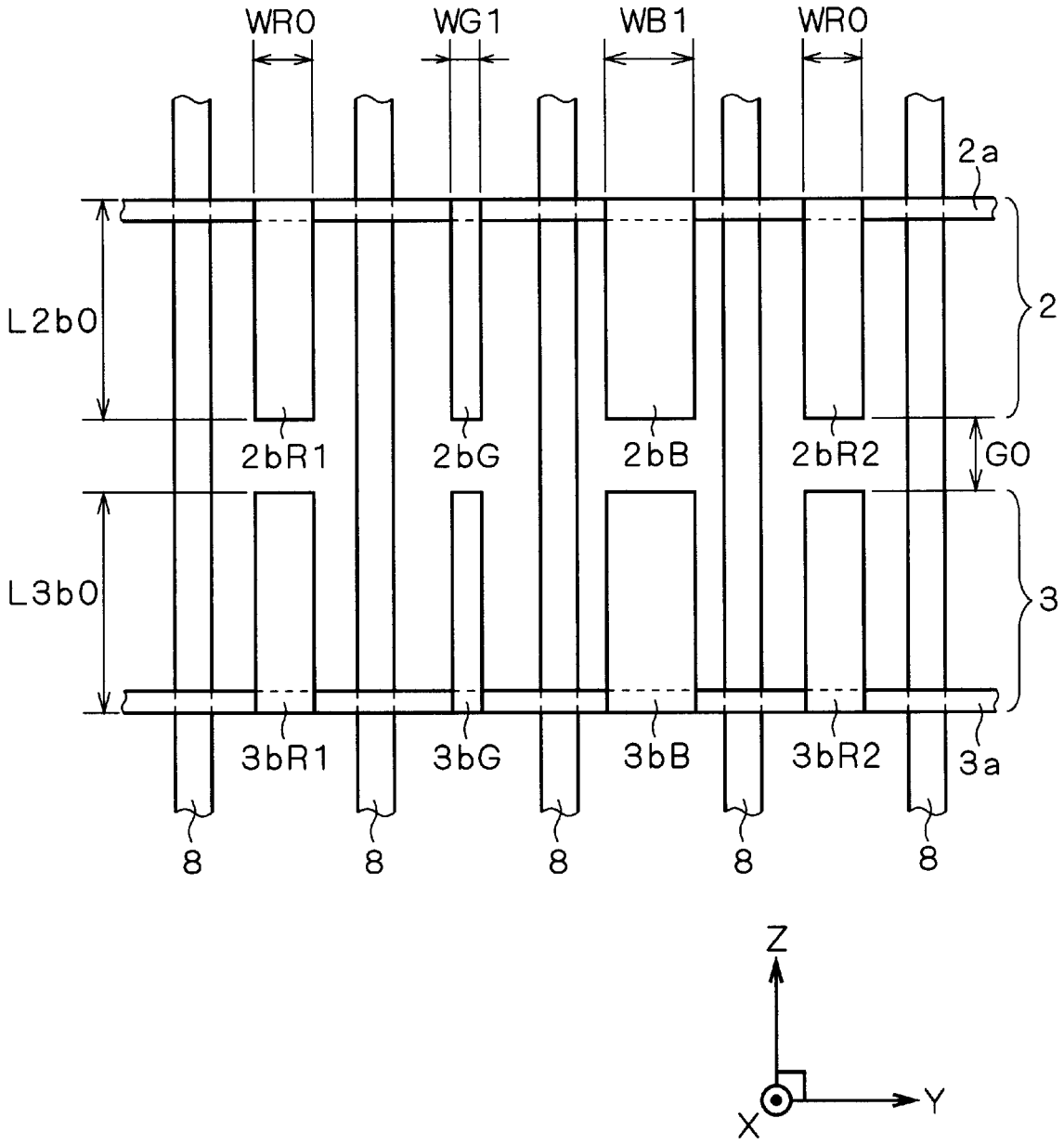
FIG. 2 is a schematic view showing a configuration of a PDP in accordance with a first preferred embodiment of the present invention.

FIG. 2 is a schematic view of a configuration of a PDP in accordance with the first preferred embodiment of the present invention, showing extracted scan electrode 2, the sustain electrode 3 and the barrier ribs 8 in four adjacent discharge cells viewed from the front panel along the X direction. The scan electrode 2 is constituted of a bus electrode 2*a* which extends in the Y direction and transparent electrodes 2*b* (2*b*R1, 2*b*G, 2*b*B and 2*b*R2 in FIG. 2) which are connected to the bus electrode 2*a* and protrude towards a center of the discharge cell in the Z direction. The transparent electrodes 2*b*R1, 2*b*G, 2*b*B and 2*b*R2 are formed individually in the respective discharge cells and electrically connected to one another only through the bus electrode 2*a* which overlaps them at their end portions on the side opposite to discharge gaps.

The sustain electrode 3 is constituted of a bus electrode 3*a* which extends in the Y direction and transparent electrodes 3*b* (3*b*R1, 3*b*G, 3*b*B and 3*b*R2 in FIG. 2) which are connected to the bus electrode 3*a* and protrude towards the center of the discharge cell in the Z direction to define the discharge gaps between themselves and the transparent electrodes 2*b*. The transparent electrodes 3*b*R1, 3*b*G, 3*b*B and 3*b*R2 are formed individually in the respective discharge cells and electrically connected to one another only through the bus electrode 3*a* which overlaps them at their end portions on the side opposite to the discharge gaps. Further, in the first preferred embodiment, the spacings of the discharge gaps between the transparent electrodes 2*b* and the transparent electrodes 3*b* in the Z direction are G0, being equal to one another.

In order to obtain the scan electrode 2 and the sustain electrode 3, the transparent electrodes 2*b* and 3*b* are formed first on the main surface of the glass substrate 1 and then the bus electrodes 2*a* and 3*a* are formed on the main surface of the glass substrate 1 to partially overlap the transparent electrodes 2*b* and 3*b*.

In the PDP of the present invention, the areas of the transparent electrodes 2*b* and 3*b* are varied depending on colors in accordance with the luminescence characteristics of the phosphors 9R, 9G and 9B and the amounts of ultraviolet rays to be irradiated on the phosphors 9R, 9G and 9B are thereby varied depending on colors, to control the luminescence intensity by colors. In the first preferred embodiment, for such a control, the widths of the transparent electrodes 2*b* and 3*b* in the Y direction are varied depending on colors. This will be discussed below, taking a case where the relation of luminescence intensities of red, green and blue in irradiation of the same amount of ultraviolet rays is G>R>B as an example. The relation of luminescence intensities depends on the luminescence characteristics of the used phosphors.

Figure 14:
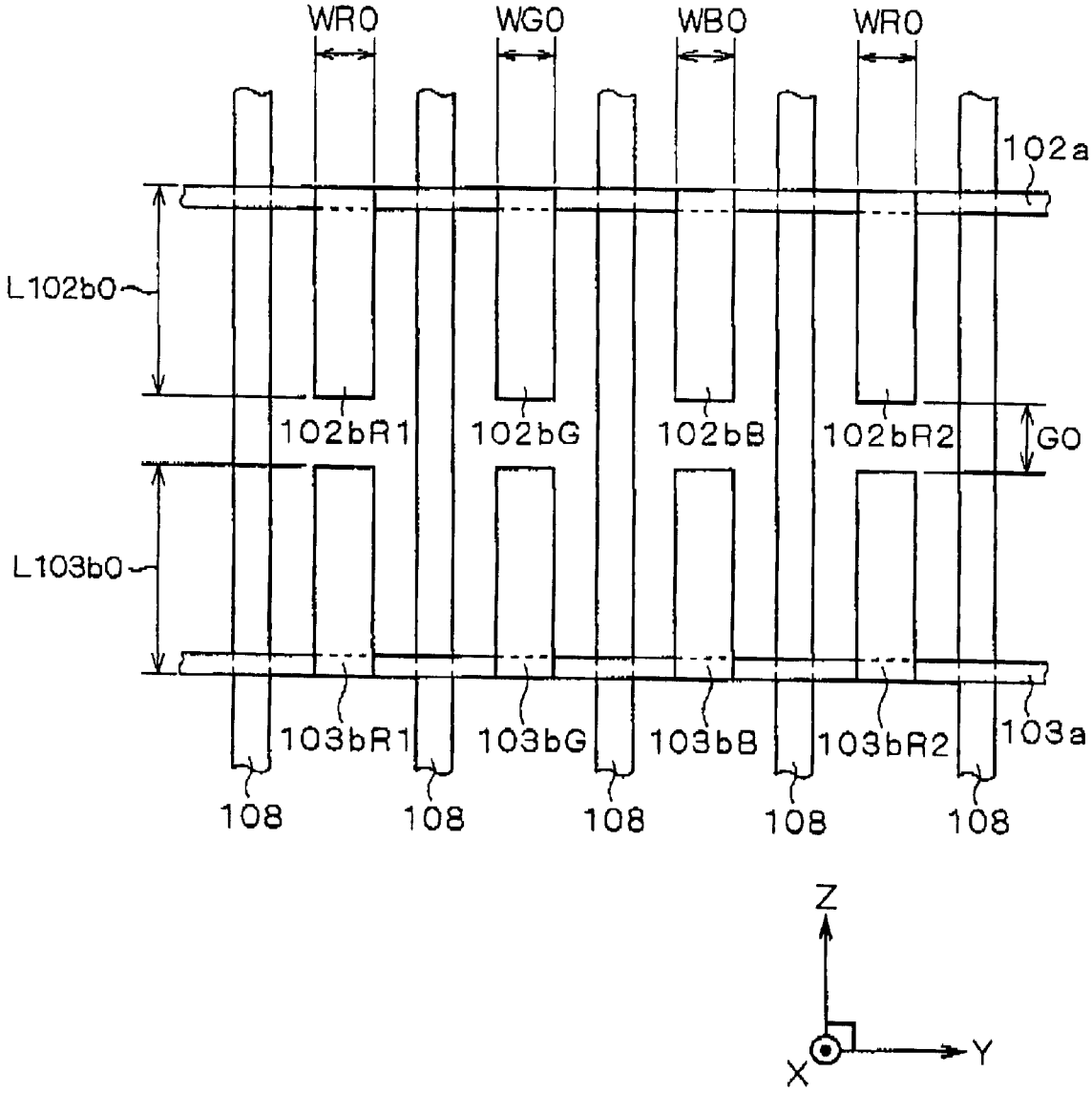
FIG. 14 PRIOR ART
FIG. 14 is a schematic view showing an arrangement of a scan electrode, a sustain electrode and barrier ribs in the PDP of the background art.
Figure 15:
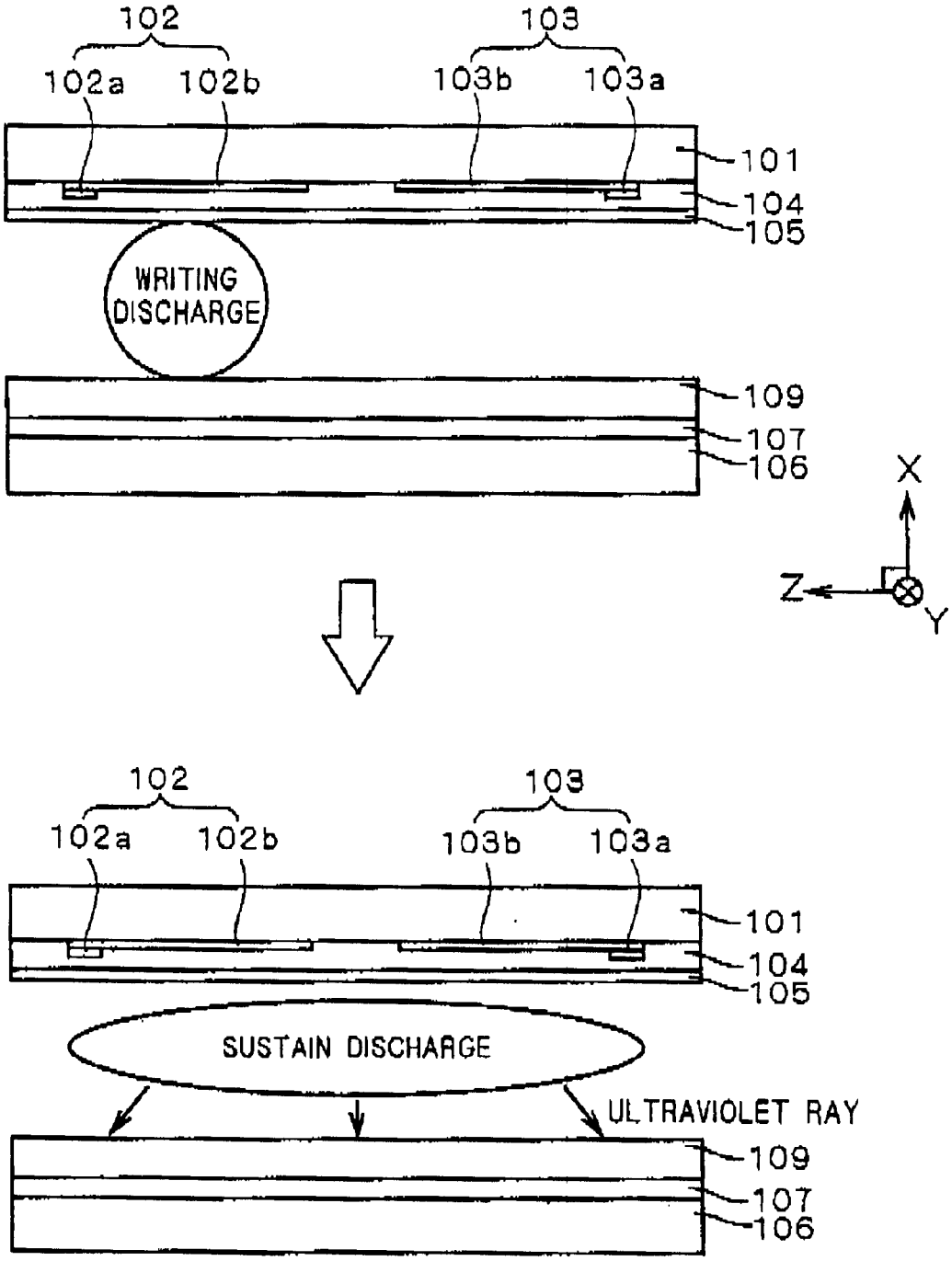
FIG. 15 PRIOR ART
FIG. 15 is a schematic view showing an operation of the PDP in the background art.

In the background-art PDP, as shown in FIG. 14, since the areas of the transparent electrodes 102*b* and 103*b* are equal among all the colors, when the same amount of ultraviolet rays are irradiated, the relation of luminescence intensities also becomes G>R>B. Specifically, since the luminescence intensity of green is strong and that of blue is weak, the color temperature of displayed white becomes low. For this reason, the gains of the input signals have to be controlled and the number of tones is thereby reduced.

In contrast to this, in the first preferred embodiment, the widths of the transparent electrodes 2*b* are varied depending on colors so that the relation of the widths WR0, WG1 and WB1 of the transparent electrodes 2*b*R (2*b*R1 and 2*b*R2 in FIG. 2), 2*b*G and 2*b*B in the Y direction may become WB1>WR0>WG1. The lengths of the transparent electrodes 2*b* in the Z direction are L2*b*0, being equal to one another.

Similarly, the widths of the transparent electrodes 3*b* are varied depending on colors so that the relation of the widths WR0, WG1 and WB1 of the transparent electrodes 3*b*R (3*b*R1 and 3*b*R2 in FIG. 2), 3*b*G and 3*b*B in the Y direction may become WB1>WR0>WG1. The lengths of the transparent electrodes 3*b* in the Z direction are L3*b*0, being equal to one another.

With this variation in width, the relation of the amounts of ultraviolet rays to be irradiated in the respective discharge cells becomes B>R>G in accordance with variation in the areas of the transparent electrodes 2*b* and 3*b*, and therefore in the case of FIG. 2, the amount of ultraviolet rays to be irradiated in the blue discharge cell increases as compared with those in the red and green discharge cells.

Thus, in the PDP of the first preferred embodiment, in accordance with the luminescence characteristics of the phosphors 9R, 9G and 9B, the width of the transparent electrodes 2*b* and 3*b* is made larger as the luminescence intensity in the discharge cell in irradiation of the same amount of ultraviolet rays becomes weaker. With this variation in width, the amounts of ultraviolet rays to be irradiated on the phosphors 9R, 9G and 9B can be varied depending on colors, and therefore it becomes possible to set the color temperature of white to a proper value without reducing the number of tones in the respective colors, unlike in the background-art PDP which controls the input gains.

The Second Preferred Embodiment

In the above first preferred embodiment, the widths of the transparent electrodes 2*b* and 3*b* are varied in accordance with the luminescence characteristics of the phosphors 9R, 9G and 9B among the discharge cells. In the discharge cell having the widest transparent electrodes 2*b*B and 3*b*B, however, as shown in FIG. 2, the two-dimensional distance (or distance in plan view) between the transparent electrodes 2*b*B and 3*b*B and the barrier rib 8 becomes short and in some cases, the transparent electrodes 2*b* and 3*b* partially overlap the barrier rib 8 two-dimensionally (or in plan view) due to misalignment in bonding the front panel and the rear panel. When the transparent electrodes 2*b* and 3*b* partially overlap the barrier rib 8, since no sustain discharge occurs in the overlapped portion, the actual effective areas of the transparent electrodes 2*b* and 3*b* become small and the effect of the first preferred embodiment is reduced. Further, in the portion of the transparent electrodes 2*b* and 3*b* overlapping the barrier rib 8, reactive power not contributing to discharge is consumed.

For this reason, the width of the transparent electrodes 2*b* and 3*b* is limited by the expected amount of misalignment in bonding the front panel and the rear panel. For example, when the distance between the adjacent barrier ribs 8 (i.e., the width of the discharge space in the Y direction) is 350 $\mu$m and the expected amount of misalignment is 50 $\mu$m, the maximum width of the transparent electrodes 2*b* and 3*b* is 250 $\mu$m considering the margin of 50 $\mu$m on either direction in order to prevent the transparent electrodes 2*b* and 3*b* and barrier ribs 8 from two-dimensionally overlapping.

The second preferred embodiment proposes a PDP which can produce the same effect as the first preferred embodiment does, ensuring sufficient margin for the above misalignment.

Figure 3:
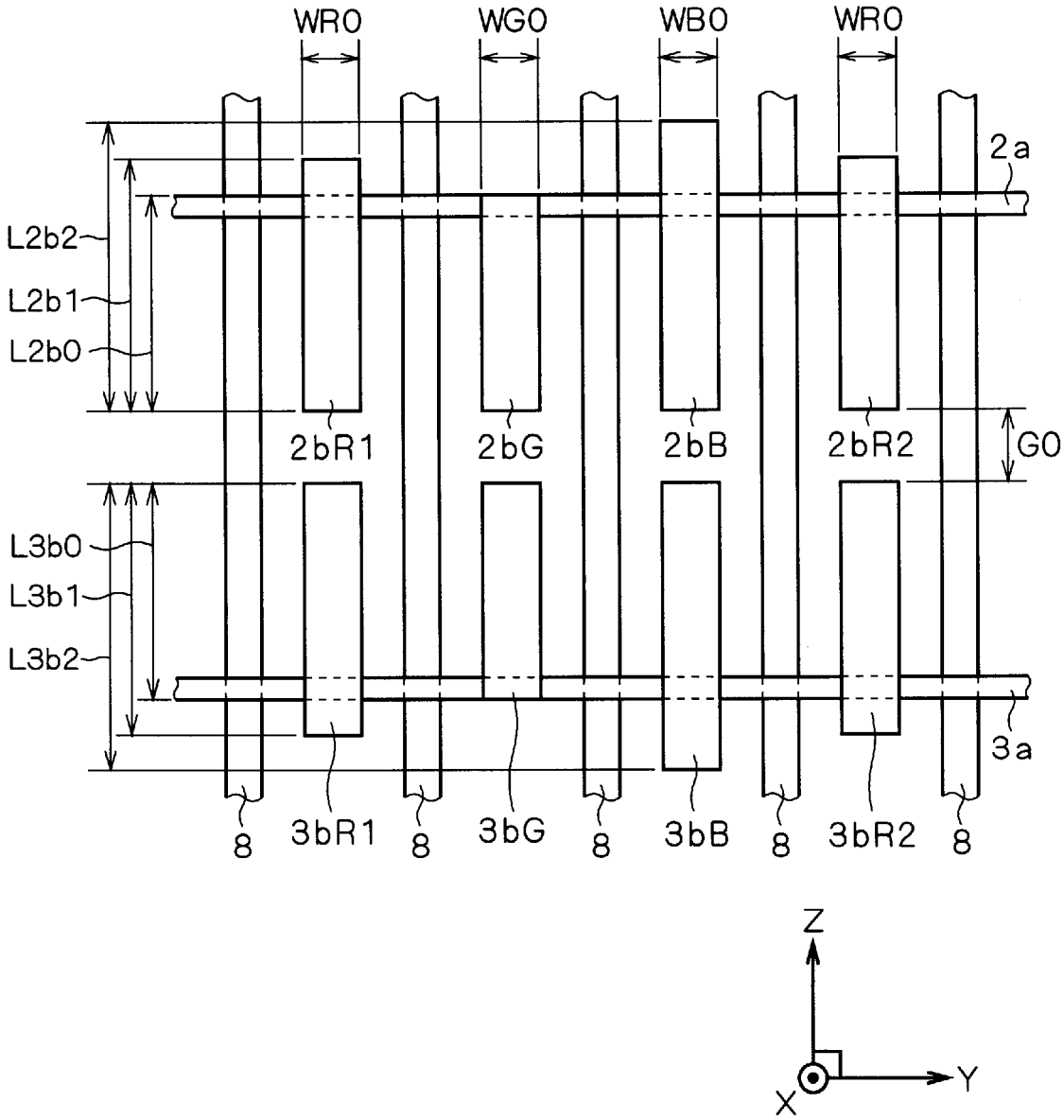
FIG. 3 is a schematic view showing a configuration of a PDP in accordance with a second preferred embodiment of the present invention.

FIG. 3 is a schematic view of a configuration of a PDP in accordance with the second preferred embodiment of the present invention, showing extracted scan electrode 2, the sustain electrode 3 and the barrier ribs 8 in four adjacent discharge cells viewed from the front panel along the X direction. In the second preferred embodiment, as shown in FIG. 3, the lengths of the transparent electrodes 2*b* and 3*b* in the Z direction are varied depending on respective colors of R, G and B. This will be discussed below, taking a case where the relation of luminescence intensities in irradiation of the same amount of ultraviolet rays is G>R>B as an example. As mentioned above, the relation of luminescence intensities depends on the luminescence characteristics of the used phosphors.

Referring to FIG. 3, in the second preferred embodiment, the lengths of the transparent electrodes 2*b* are varied depending on colors so that the relation of the lengths L2*b*1, L2*b*0 and L2*b*2 of the transparent electrodes 2*b*R (2*b*R1 and 2*b*R2 in FIG. 3), 2*b*G and 2*b*B in the Z direction may become L2*b*2>L2*b*1>L2*b*0. The widths WR0, WG0 and WB0 of the transparent electrodes 2*b*R, 2*b*G and 2*b*B in the Y direction are equal to one another.

Similarly, the lengths of the transparent electrodes 3*b* are varied depending on colors so that the relation of the lengths L3*b*1, L3*b*0 and L3*b*2 of the transparent electrodes 3*b*R (3*b*R1 and 3*b*R2 in FIG. 3), 3*b*G and 3*b*B in the Z direction may become L3*b*2>L3*b*1>L3*b*0. The widths WR0, WG0 and WB0 of the transparent electrodes 3*b*R, 3*b*G and 3*b*B in the Y direction are equal to one another.

With this variation in length, the discharge space is extended in the Z direction in the discharge cell in which the length of the transparent electrodes 2*b* and 3*b* is made longer. Specifically, the relation of the areas of the phosphors 9R, 9G and 9B irradiated with the ultraviolet rays generated from the sustain discharge becomes B>R>G in accordance with variation in the areas of the transparent electrodes 2*b* and 3*b* caused by the difference in length in the Z direction, and therefore in the case of FIG. 3, the amount of ultraviolet rays to be irradiated in the blue discharge cell increases as compared with those in the red and green discharge cells.

Further, also in the second preferred embodiment, like in the first preferred embodiment, the spacings of the discharge gaps between the transparent electrodes 2*b* and the transparent electrodes 3*b* in the Z direction are G0, being equal to one another. In this case, in order to prevent the wrong discharge caused by interference between the adjacent discharge cells (not shown in FIG. 3) in the Z direction, it is necessary to specify the spacing G0 of the discharge gap as below. Specifically, paying attention to the longest transparent electrode (2*b*B and 3*b*B in FIG. 3), the spacing G0 of the discharge gap has to be specified so that the spacing between an upper end of the transparent electrode 2*b*B shown in FIG. 3 and a lower end of the transparent electrode 3*b*B not shown but actually existing above this transparent electrode 2*b*B in this figure and the spacing between the lower end of the transparent electrode 3*b*B shown in FIG. 3 and an upper end of the transparent electrode 2*b*B not shown but actually existing below this transparent electrode 3*b*B in this figure may become larger than the spacing G0.

Thus, in the PDP of the second preferred embodiment, in accordance with the luminescence characteristics of the phosphors 9R, 9G and 9B, the length of the transparent electrodes 2*b* and 3*b* is made longer as the luminescence intensity in the discharge cell in irradiation of the same amount of ultraviolet rays becomes weaker. With this variation in length, the amounts of ultraviolet rays to be irradiated on the phosphors 9R, 9G and 9B can be varied depending on colors, and therefore it becomes possible to set the color temperature of white to a proper value without reducing the number of tones in the respective colors, like in the first preferred embodiment.

Further, unlike in the first preferred embodiment, since the width of the transparent electrodes 2*b* and 3*b* is not extended, it is possible to ensure sufficient allowance of misalignment for all the colors in bonding the front panel and the rear panel.

Furthermore, as shown in FIG. 3, the bus electrodes 2*a* and 3*a* should be preferably disposed on end portions of the shortest transparent electrodes 2*b* and 3*b* (2*b*G and 3*b*G in FIG. 3) on the sides opposite to the discharge gap. This makes it possible to most effectively suppress deterioration in luminance caused by the presence of the bus electrodes 2*a* and 3*a*.

Figure 4:
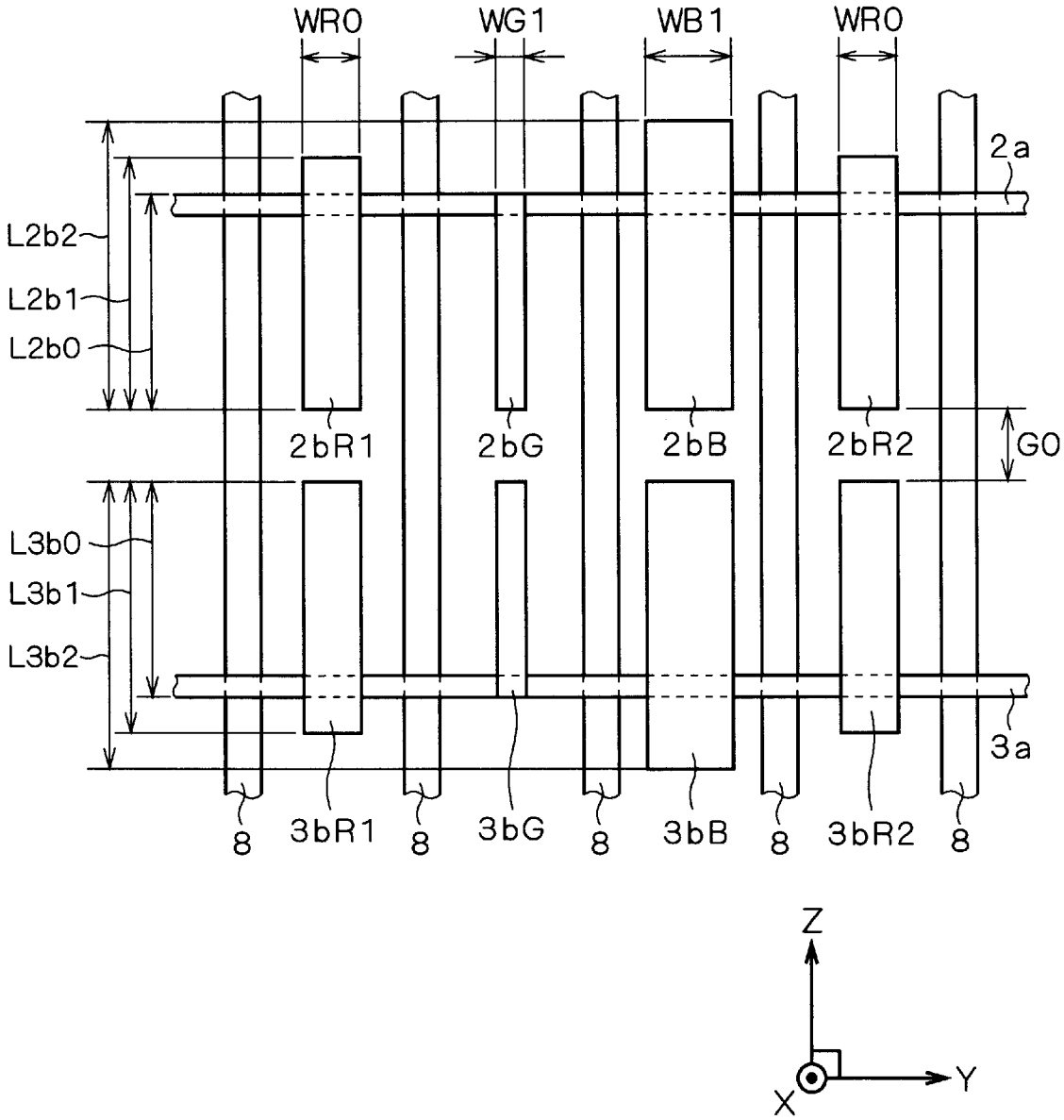
FIG. 4 is a schematic view showing a configuration of a PDP in accordance with a combination of the first and second preferred embodiments of the present invention.

The invention in accordance with the second preferred embodiment can be applied, being combined with that in accordance with the first preferred embodiment. FIG. 4 is a schematic view of a configuration of a PDP in accordance with such a combination, showing extracted scan electrode 2, the sustain electrode 3 and the barrier ribs 8 in four adjacent discharge cells viewed from the front panel along the X direction. In the PDP of FIG. 4, in order to vary the areas of the transparent electrodes 2*b* and 3*b* depending on colors in accordance with the luminescence characteristics of the phosphors 9R, 9G and 9B, the widths of the transparent electrodes 2*b* and 3*b* in the Y direction are varied depending on colors like in the first preferred embodiment and the lengths of the transparent electrodes 2*b* and 3*b* in the Z direction are varied depending on colors like in the second preferred embodiment. Further, the spacings of the discharge gaps between the transparent electrodes 2*b* and the transparent electrodes 3*b* in the Z direction are G0, being equal to one another.

Thus, applying combination of the invention in accordance with the second preferred embodiment and that in accordance with the first preferred embodiment enhances the effect of increasing the amount of ultraviolet rays to be irradiated on the phosphor 9R, 9G or 9B in the discharge cell whose luminescence intensity would be weak in irradiation of the same amount of ultraviolet rays.

The Third Preferred Embodiment

In the discharge cell where the wall charges are accumulated from the writing discharge, when the sum (sustain voltage) of a voltage caused by the wall charges and an external voltage applied to the scan electrode 2 exceeds the firing voltage of the sustain discharge in the subsequent discharge sustain period, the sustain discharge occurs between the scan electrode 2 and the sustain electrode 3. In this case, the firing voltages of the writing discharge vary depending on the discharge cells for the respective colors in accordance with the luminescence characteristics of the phosphors 9R, 9G and 9B. In the discharge cell whose firing voltage of the writing discharge is high, a wrong discharge leading to not-lighting of a discharge cell which should be lighted may occur because of small amount of accumulated wall charges. Such a wrong discharge can be prevented by applying higher external voltage with some voltage margin given to the sustain voltage relative to the firing voltage of the sustain discharge.

In the case of making such a control, however, excessive external voltage is applied to the discharge cell where the firing voltage of the writing discharge is low and the wall charges are sufficiently accumulated and therefore, a reset discharge which should be generated until the writing discharge in the next subfield can not be sufficiently generated. This causes another wrong discharge, that is, a writing discharge in the discharge cell where the writing discharge should not be generated. Further, since most of the power consumption of the PDP is caused by the sustain discharge, the power consumption becomes high when the sustain discharge is high. Furthermore, though the method in which the voltage to cause the writing discharge is set individually for the phosphors of respective colors is possible, it invites a rise of cost because three kinds of external power supplies are needed.

Then, to solve the above problem, the third preferred embodiment proposes a PDP which can uniformize the incidence of the sustain discharges in the discharge cells for the respective colors, using only one kind of external power supply.

Figure 5:
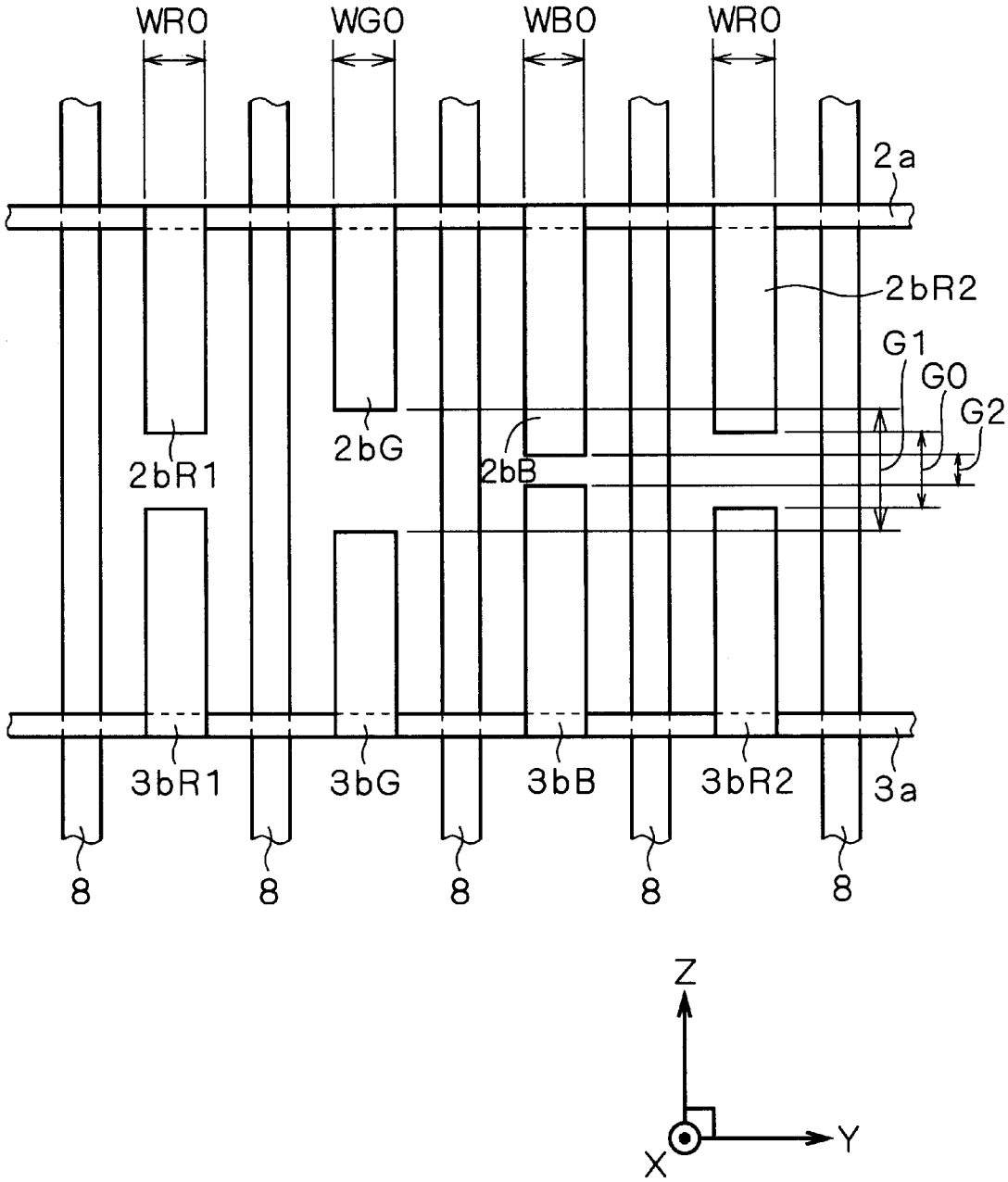
FIG. 5 is a schematic view showing a configuration of a PDP in accordance with a third preferred embodiment of the present invention.

FIG. 5 is a schematic view of a configuration of a PDP in accordance with the third preferred embodiment of the present invention, showing extracted scan electrode 2, the sustain electrode 3 and the barrier ribs 8 in four adjacent discharge cells viewed from the front panel along the X direction. In the third preferred embodiment, as shown in FIG. 5, the spacings of the discharge gaps between the transparent electrodes 2*b* and 3*b* in the Z direction are varied depending on respective colors R, G and B. This will be discussed below, taking a case where the relation of the firing voltages of the writing discharges for red, green and blue is G>R>B as an example. Further, the relation of the firing voltages of the writing discharges depends on the luminescence characteristics of the used phosphors.

Referring to FIG. 5, in the third preferred embodiment, the relation of the discharge gap G0 between the transparent electrodes 2*b*R (2*b*R1 and 2*b*R2 in FIG. 5) and 3*b*R (3*b*R1 and 3*b*R2 in FIG. 5), the discharge gap G1 between the transparent electrodes 2*b*G and 3*b*G and the discharge gap G2 between the transparent electrodes 2*b*B and 3*b*B is set to G1>G0>G2. The widths of the transparent electrodes 2*b* and 3*b* are equal to one another.

Since the voltages applied between the scan electrode 2 and the write electrodes 7R, 7G and 7B in writing are equal among the discharge cells for all the colors, the relation of the amounts of wall charges accumulated from the writing discharge is R>B>G in accordance with the difference in luminescence characteristics of the phosphors 9R, 9G and 9B.

In the third preferred embodiment, the spacings of the discharge gaps are varied depending on the discharge cells for respective colors in accordance with difference in firing voltage of the writing discharge caused by the difference in luminescence characteristics of the phosphors 9R, 9G and 9B, in other words, in accordance with probability of the sustain discharge caused by the difference in the amount of electric charges accumulated after the writing. Specifically, the spacing of the discharge gap is set narrower as the firing voltage of the writing discharge in the discharge cell becomes higher.

Accordingly, in the PDP of the third preferred embodiment, since it is possible to uniformize the voltage margin of the sustain voltage relative to the firing voltage of the sustain discharge among the discharge cells for all the colors regardless of variation in the amount of accumulated wall charges when a voltage is applied to the scan electrode 2 from the external power supply in the subsequent sustain period, it becomes possible to suppress variation in incidence of the sustain discharges among the discharge cells for all the colors. This prevents the above wrong discharge caused by insufficient reset discharge.

Figure 6:
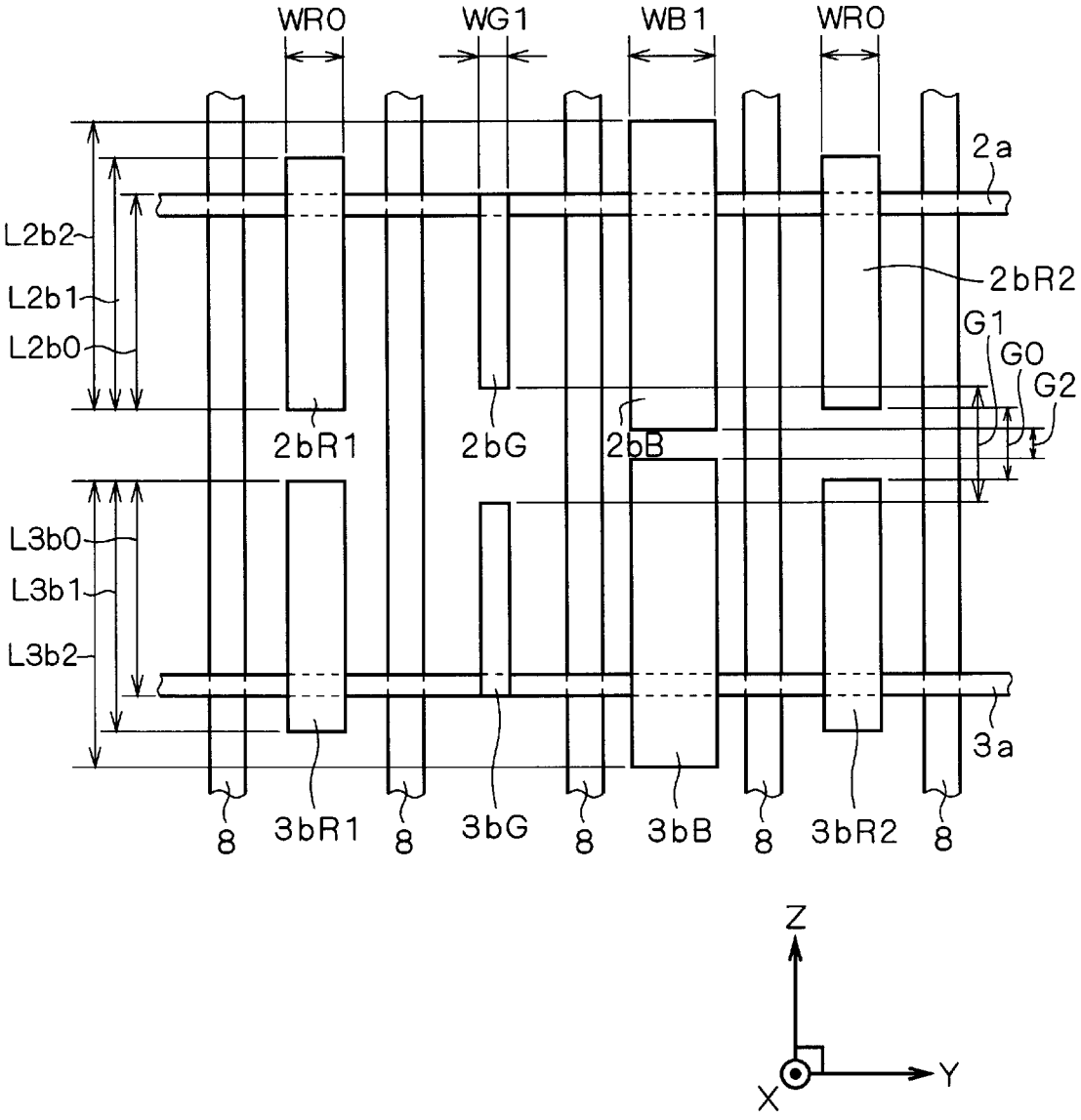
FIG. 6 is a schematic view showing a configuration of a PDP in accordance with a combination of the first to third preferred embodiments of the present invention.

The invention in accordance with the third preferred embodiment can be applied, being combined with those in accordance with the first and second preferred embodiments. FIG. 6 is a schematic view of a configuration of a PDP in accordance with such a combination of the first to third preferred embodiments, showing extracted scan electrode 2, the sustain electrode 3 and the barrier ribs 8 in four adjacent discharge cells viewed from the front panel along the X direction. In the PDP of FIG. 6, the widths of the transparent electrodes 2*b* and 3*b* in the Y direction are varied depending on colors like in the first preferred embodiment, the lengths of the transparent electrodes 2*b* and 3*b* in the Z direction are varied depending on colors like in the second preferred embodiment and the spacings of the discharge gaps in the Z direction are varied depending on colors like in the third preferred embodiment.

Thus, applying combination of the invention in accordance with the third preferred embodiment and those in accordance with the first and second preferred embodiments produces an effect of increasing the amount of ultraviolet rays to be irradiated on the phosphor 9R, 9G or 9B in the discharge cell whose luminescence intensity would be weak in irradiation of the same amount of ultraviolet rays and also produces an effect of suppressing variation in incidence of the sustain discharges among the discharge cells for all the colors.

Hereafter, discussion will be made on PDPs in accordance with other variations of the present invention. The following variations can be applied, being combined with the above first to third preferred embodiments or any other variations.

In the above preferred embodiments, discussion has been made on the case where the widths or lengths of the transparent electrodes 2*b* and 3*b* both in the scan electrode 2 and sustain electrode 3 are varied. There may be a case, however, where the shapes of the transparent electrodes 2*b* or 3*b* in either one of the scan electrode 2 and sustain electrode 3 are varied.

Figure 7:
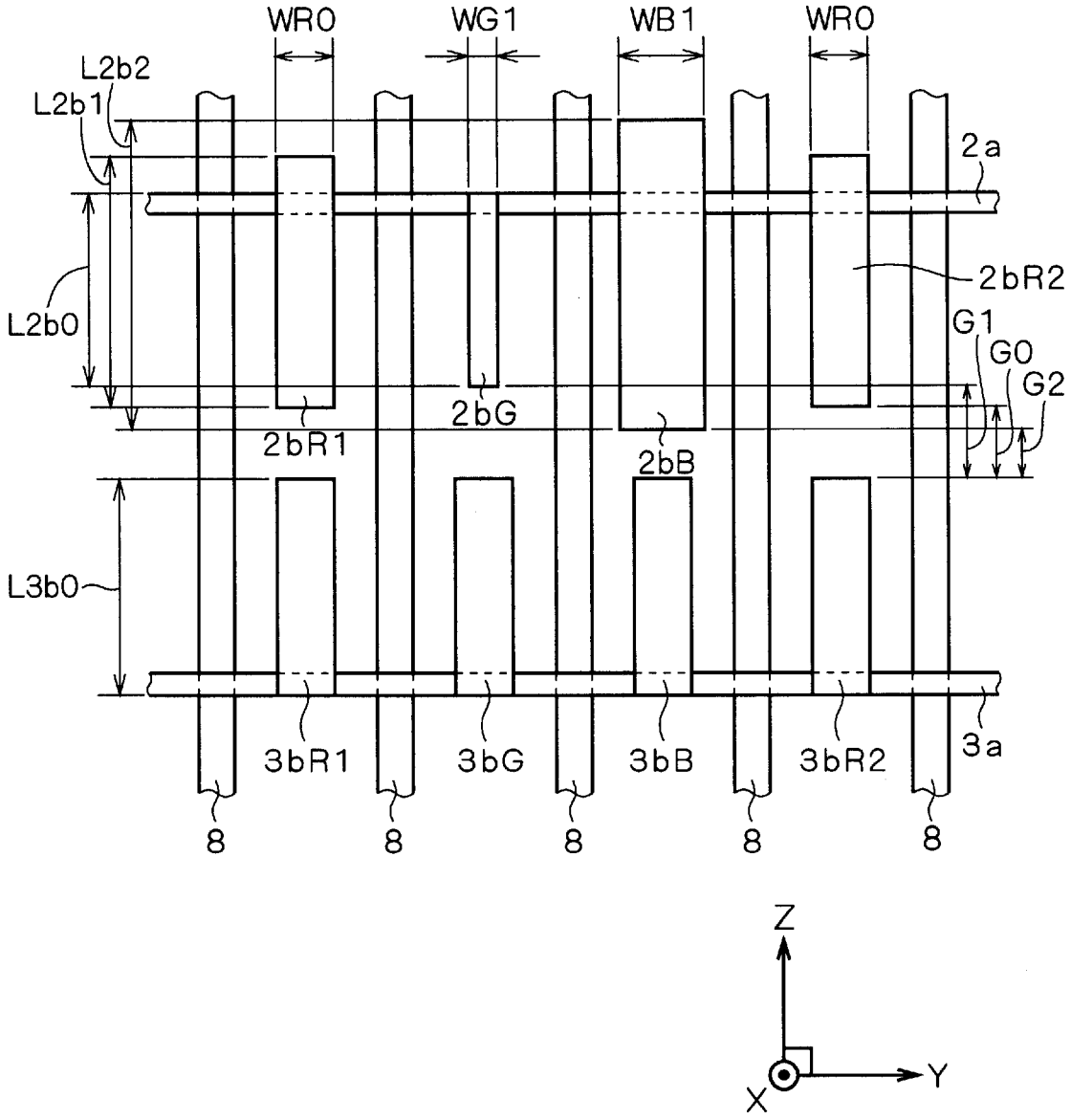
FIG. 7 is a schematic view showing a configuration of a PDP in accordance with a first variation of the present invention.

FIG. 7 is a schematic view of a configuration of a PDP in accordance with the first variation, showing extracted scan electrode 2, the sustain electrode 3 and the barrier ribs 8 in four adjacent discharge cells viewed from the front panel along the X direction. As shown in FIG. 7, only the shape of the scan electrode 2 is varied, to achieve variation in widths and lengths of the transparent electrodes 2*b* and control of the spacings of the discharge gaps in accordance with the first to third preferred embodiments. The widths and lengths of the transparent electrodes 3*b*R1, 3*b*G, 3*b*B and 3*b*R2 in the sustain electrode 3 are equal to one another.

In the PDP in accordance with the first variation of the present invention, when the transparent electrodes 2*b* and 3*b* are formed, since the transparent electrodes 3*b* are formed first with equal spacings and then the transparent electrodes 2*b* are formed aligning with the transparent electrodes 3*b*, the scan electrode 2 and the sustain electrode 3 can be manufactured with relatively high precision.

Further, in the above preferred embodiments, the transparent electrodes 2*b* and 3*b* are formed individually in respective discharge cells, and the transparent electrodes 2*b* adjacent in the Y direction are electrically connected to each other through the bus electrode 2*a* and the transparent electrodes 3*b* adjacent in the Y direction are electrically connected to each other through the bus electrode 3*a*. There may be a case, however, where the transparent electrodes 2*b* adjacent in the Y direction are electrically connected to each other through part of the transparent electrode and the transparent electrodes 3*b* adjacent in the Y direction are electrically connected to each other through part of the transparent electrode.

Figure 8:
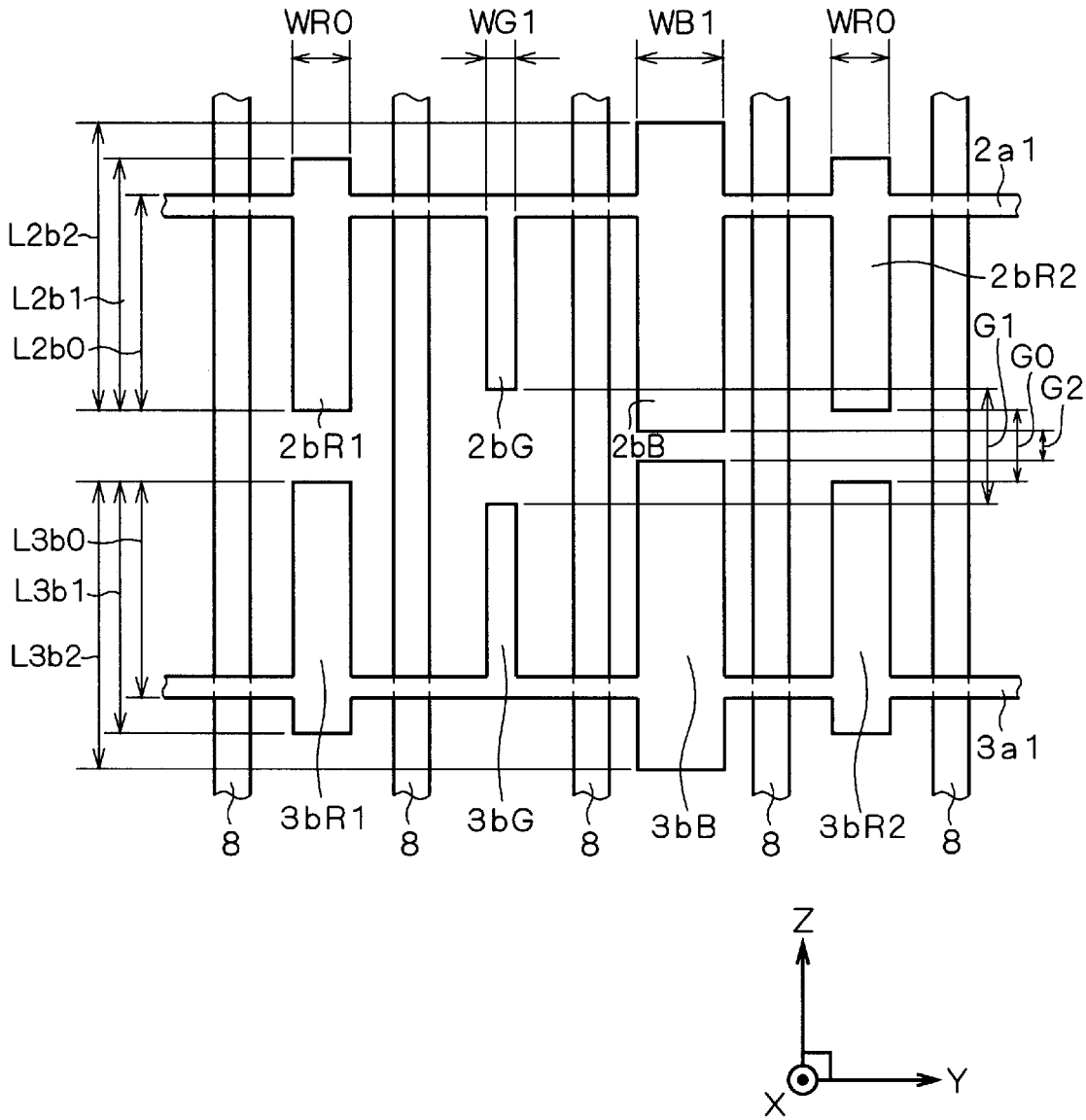
FIG. 8 is a schematic view showing a configuration of a PDP in accordance with a second variation of the present invention.

FIG. 8 is a schematic view of a configuration of a PDP in accordance with the second variation, showing extracted scan electrode 2, the sustain electrode 3 and the barrier ribs 8 in four adjacent discharge cells viewed from the front panel along the X direction. In the scan electrode 2, the transparent electrodes adjacent in the Y direction, e.g., 2*b*R1 and 2*b*G, are electrically connected to each other through part of the transparent electrode (2*a*1 in FIG. 8) formed on the main surface of the glass substrate 1, not through the bus electrode 2*a*. Further, in the sustain electrode 3, the transparent electrodes adjacent in the Y direction, e.g., 3*b*G and 3*b*B, are electrically connected to each other through part of the transparent electrode (3*a*1 in FIG. 8) formed on the main surface of the glass substrate 1, not through the bus electrode 3*a*.

Further, in the above preferred embodiments, the bus electrode 2*a* and the transparent electrodes 2*b* connected to the bus electrode 2*a* constitute the scan electrode 2 and the bus electrode 3*a* and the transparent electrodes 3*b* connected to the bus electrode 3*a* constitute the sustain electrode 3. As disclosed in e.g., Japanese Patent Application Laid-Open No. 8-22772 (1996), however, frame-like electrodes having the same shape as the rims of the transparent electrodes 2*b* and 3*b* may be formed of the same material as the bus electrodes 2*a* and 3*a* (i.e., material having lower transparency and higher electric conductivity than that of the transparent electrode), instead of the transparent electrodes 2*b* and 3*b*.

Figure 9:
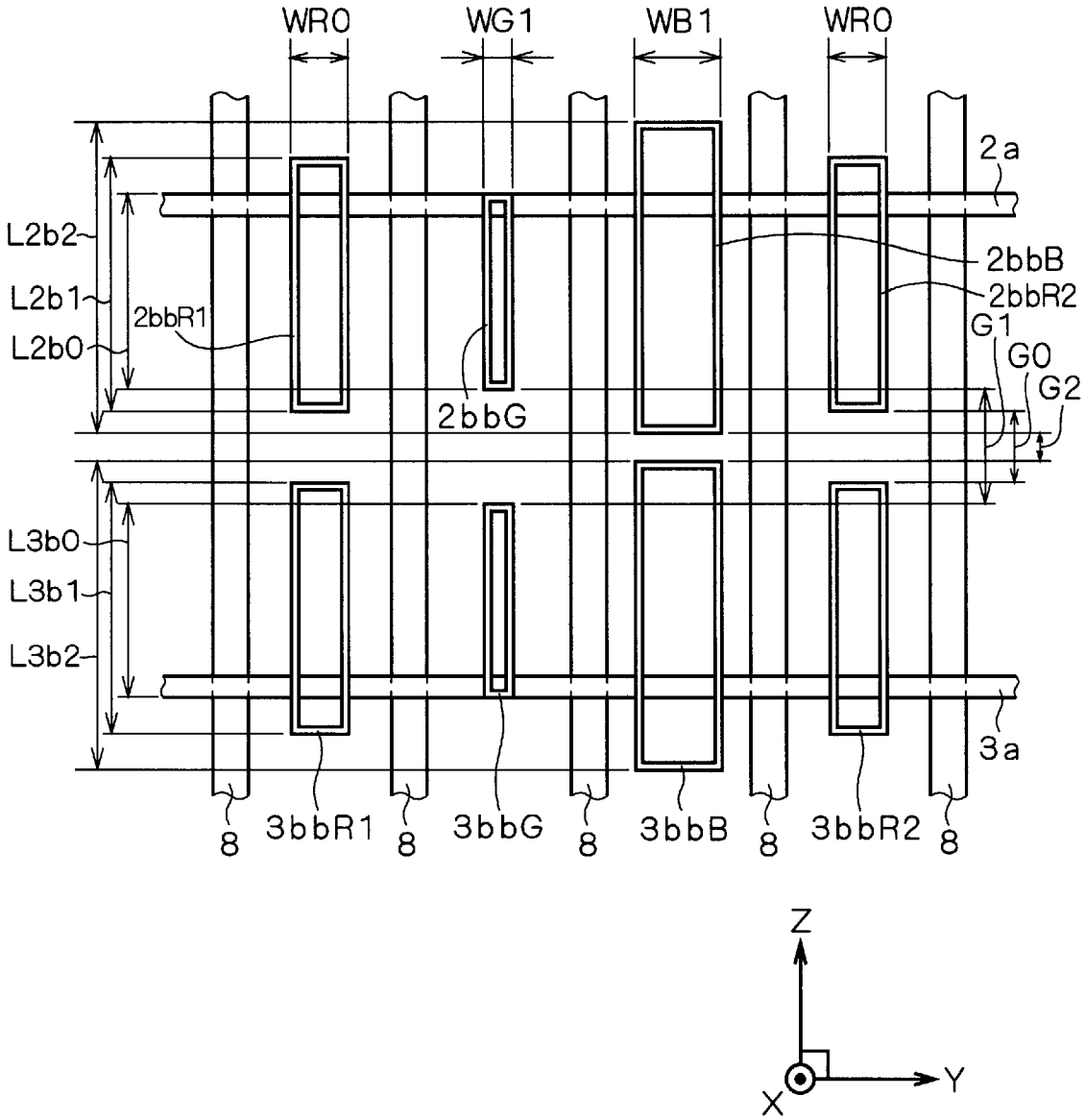
FIG. 9 is a schematic view showing a-configuration of a PDP in accordance with a third variation of the present invention.

FIG. 9 is a schematic view of a configuration of a PDP in accordance with the third variation, showing extracted scan electrode 2, the sustain electrode 3 and the barrier ribs 8 in four adjacent discharge cells viewed from the front panel along the X direction. Frame-like electrodes 2*bb* and 3*bb* (2*bb*R1, 2*bb*G, 2*bb*B, 2*bb*R2, 3*bb*R1, 3*bb*G, 3*bb*B and 3*bb*R2 in FIG. 9) made of low-resistance material such as silver or aluminum are formed first on the main surface of the glass substrate 1 and then the bus electrodes 2*a* and 3*a* are formed on the main surface of the glass substrate 1 partially overlapping the frame-like electrodes 2*bb* and 3*bb*.

In the PDP in accordance with the third variation of the present invention, since the bus electrodes 2*a* and 3*a* and the frame-like electrodes 2*bb* and 3*bb* can be made of the same material, the material of the transparent electrode is not needed and reduction in cost can be thereby achieved. Further, since the electrodes 2*bb* and 3*bb* having low transparency are formed in a frame shape, it is possible to suppress deterioration in luminance of the PDP.

Further, in the PDP of the third variation, the frame-like electrodes 2*bb* and 3*bb* are formed first and then the bus electrodes 2*a* and 3*a* are formed, partially overlapping the frame-like electrodes 2*bb* and 3*bb*. The frame-like electrodes 2*bb* and 3*bb* and the bus electrodes 2*a* and 3*a*, however, may be formed through the same process step.

Figure 10:
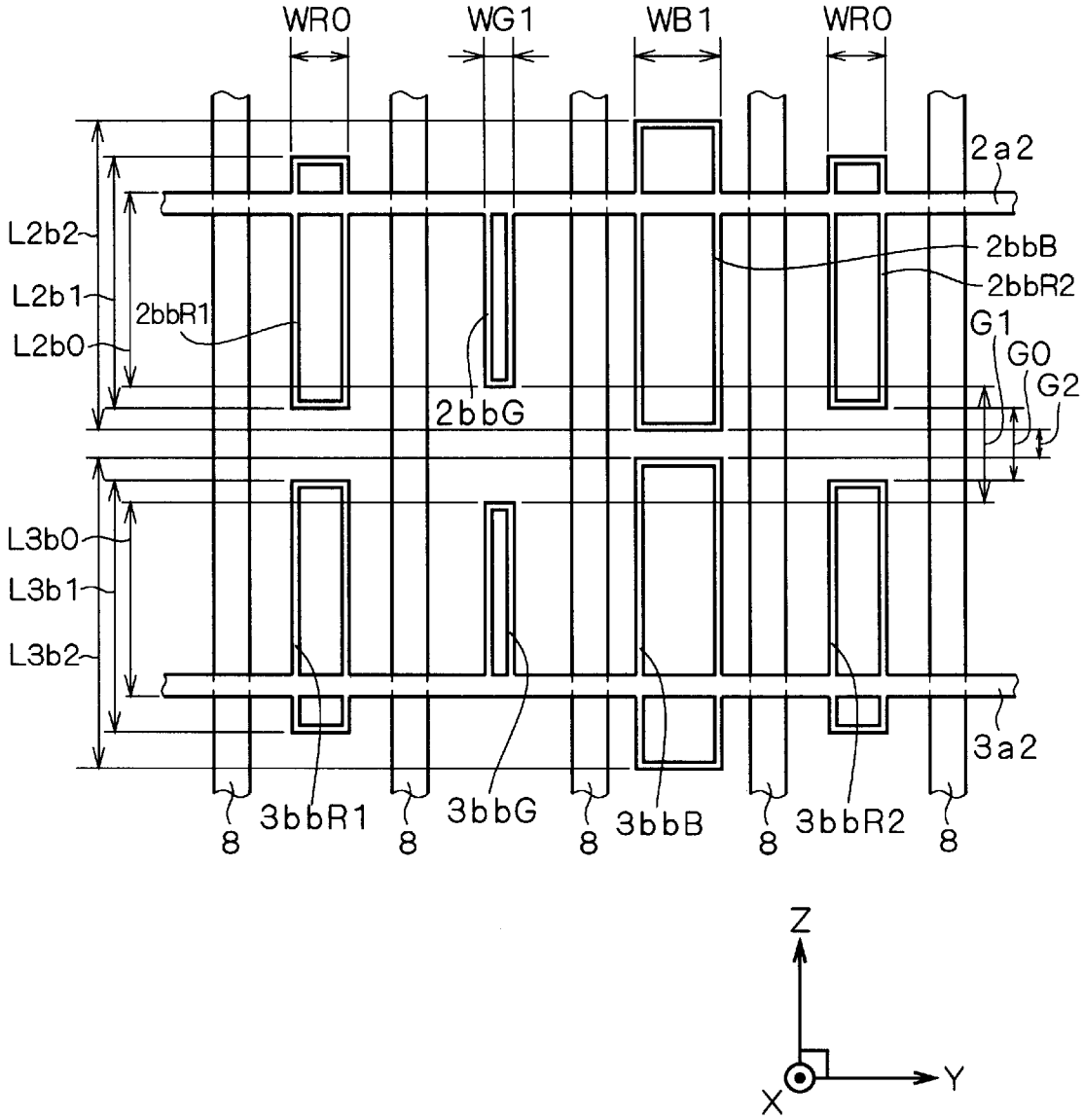
FIG. 10 is a schematic view showing a configuration of a PDP in accordance with a fourth variation of the present invention.

FIG. 10 is a schematic view of a configuration of a PDP in accordance with the fourth variation, showing extracted scan electrode 2, the sustain electrode 3 and the barrier ribs 8 in four adjacent discharge cells viewed from the front panel along the X direction. On the main surface of the glass substrate 1, the frame-like electrodes 2*bb* and 3*bb* and bus electrodes 2*a*2 and 3*a*2 are formed in a layer through the same process step.

Figure 16:
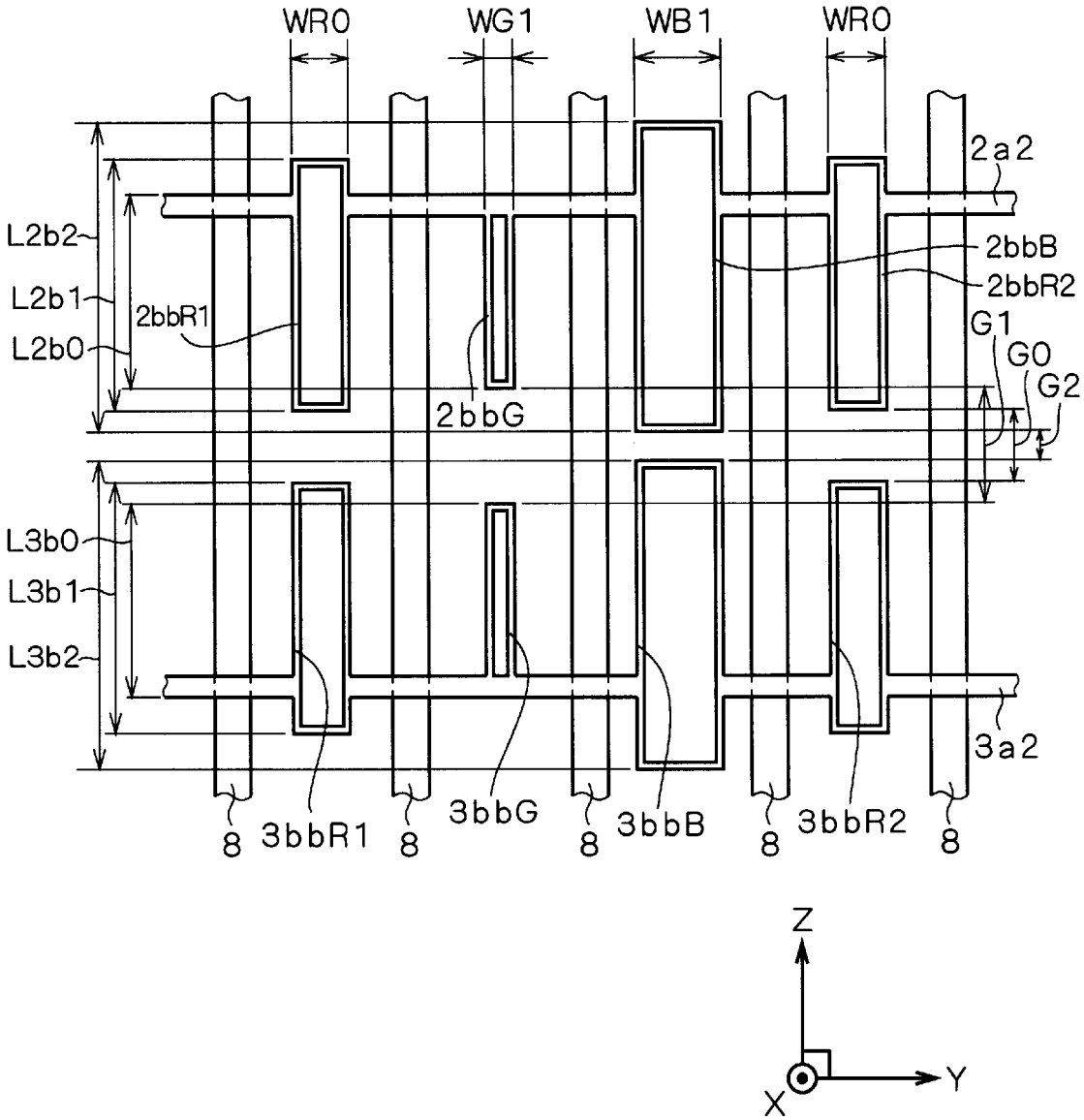
FIG. 16 is a schematic view showing another configuration of the PDP in accordance with the fourth variation of the present invention.

In the PDP in accordance with the fourth variation of the present invention, when the scan electrode 2 and the sustain electrode 3 are formed, the process step in which the bus electrodes 2*a* and 3*a* are aligned and formed in predetermined portions on the frame-like electrodes 2*bb* and 3*bb* is not needed and manufacture process is thereby simplified. Further, in the fourth variation, the bus electrodes 2*a*2 and 3*a*2 may be formed only outside the rims of the frame-like electrodes 2*bb* and 3*bb* as shown in FIG. 16. By removing the bus electrodes 2*a*2 and 3*a*2 in portions inside the frames of the frame-like electrodes 2*bb* and 3*bb,* the area to obstruct the light from the discharge space towards the glass substratel can be reduced and the luminance of the PDP is thereby enhanced.

Furthermore, in the above preferred embodiments, the phosphphor 9 is coated on the surface of the concave portion made by the side surfaces of the barrier ribs 8 and the main surface of the glass substrate 6 in the rear panel. The phosphor, however, may be also formed on the side of the front panel.

Figure 11:
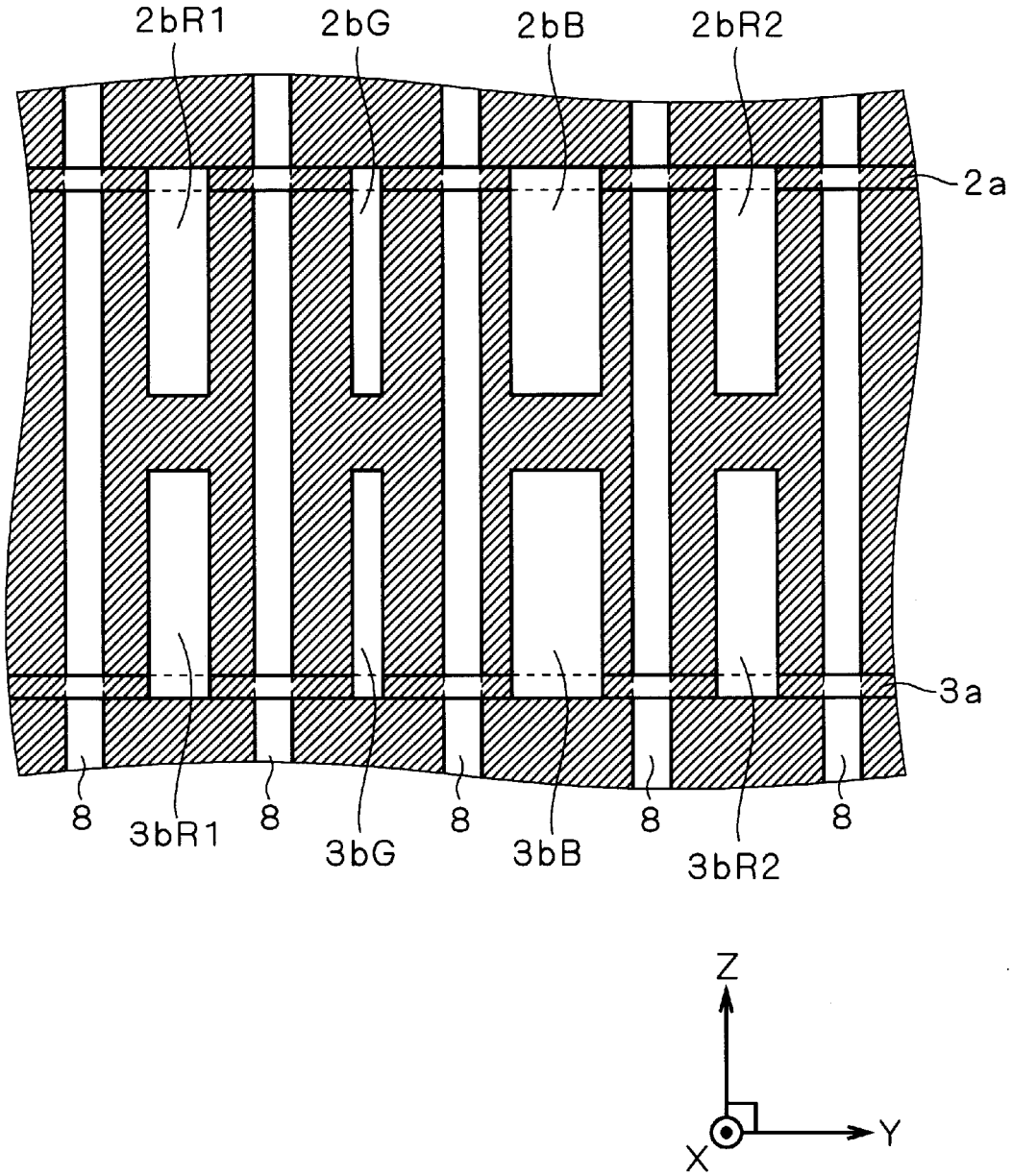
FIG. 11 is a schematic view showing a configuration of a PDP in accordance with a fifth variation of the present invention.

FIG. 11 is a schematic view of a configuration of a PDP in accordance with the fifth variation, showing extracted scan electrode 2, the sustain electrode 3 and the barrier ribs 8 in four adjacent discharge cells viewed from the front panel along the X direction. In portions which do not two-dimensionally overlap the transparent electrodes 2*b* or 3*b* or the barrier ribs 8 as hatched in FIG. 11, phosphors having the same colors as the phosphors coated on the rear panel are formed on the protection film 5 with a predetermined thickness with a binding agent (inorganic solvent containing ultra-fine particles such as alumina or silica, and the like) mixed therein. As far as the phosphors formed in the adjacent cells do not interfere with each other, the phosphors may be formed in portions which two-dimensionally overlap the barrier ribs 8.

Further, there may be a case where the protection film 5 is formed only in the portions which two-dimensionally overlap the scan electrode 2 and the sustain electrode 3, not entirely on the dielectric layer 4, and the phosphors are formed in portions of the dielectric layer 4 which are exposed from the scan electrode 2 and the sustain electrode 3 so as not to interfere with the phosphors formed in the adjacent cells. In this case, it is not necessary to mix the binding agent in the phosphor.

Furthermore, the phosphors may be formed between the dielectric layer 4 and the protection film 5, not on the protection film 5. Also in this case, it is preferable that the phosphors should be formed only in the portions which two-dimensionally overlap the scan electrode 2 and the sustain electrode 3.

In the PDP in accordance with the fifth variation of the present invention, since the phosphors are coated not only on the side of the rear panel but also in the predetermined portions on the side of the front panel, it is possible to increase the luminance of the PDP.

The above discussion of the fifth variation has been made on the case where the invention of the fifth variation is applied to the PDP in which the transparent electrodes 2*b* and 3*b* are formed. The invention of the fifth variation may be applied to the PDP in which the frame-like electrodes 2*bb* and 3*bb* are formed.

Figure 12:
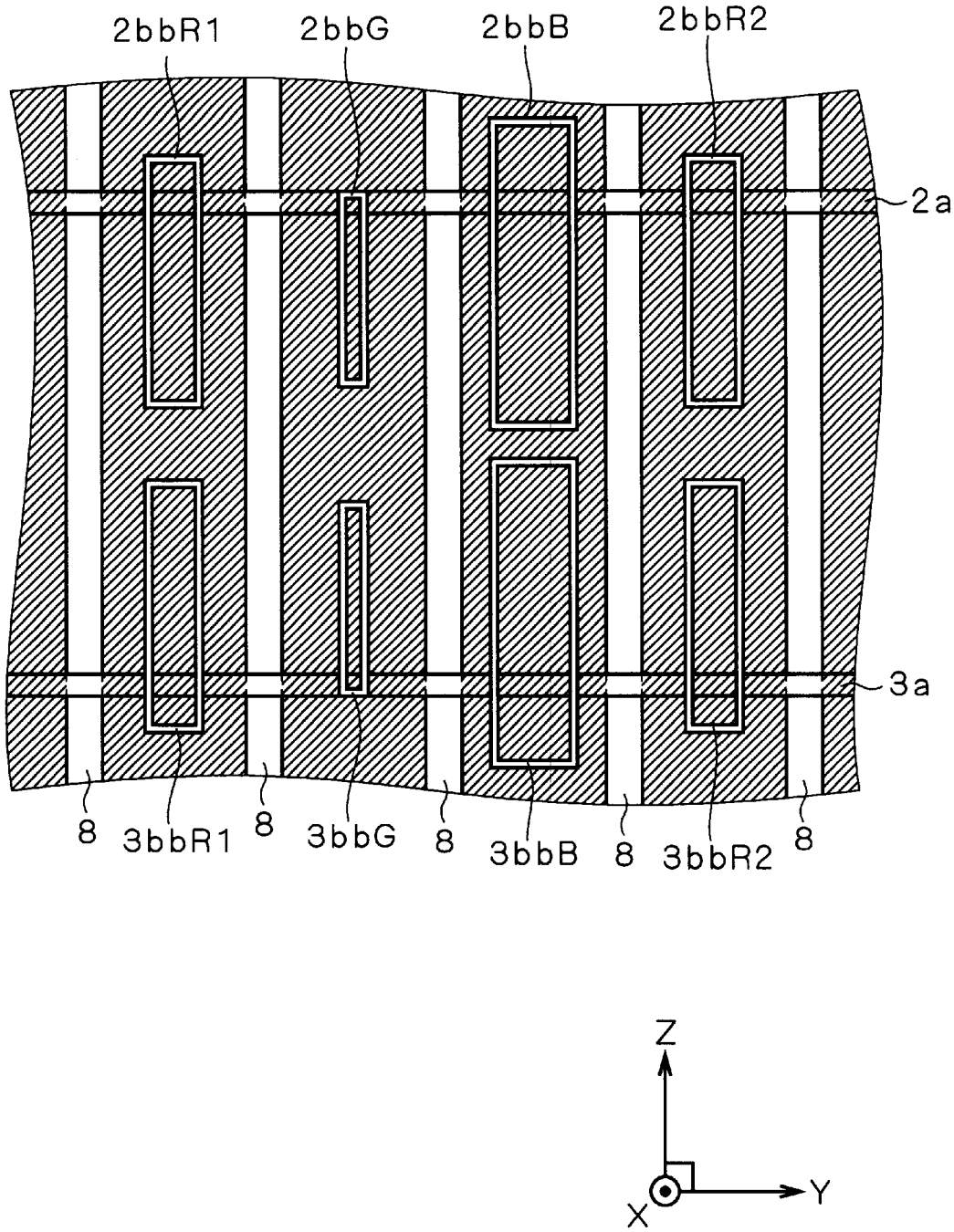
FIG. 12 is a schematic view showing a configuration of a PDP in accordance with a sixth variation of the present invention.
Figure 13:
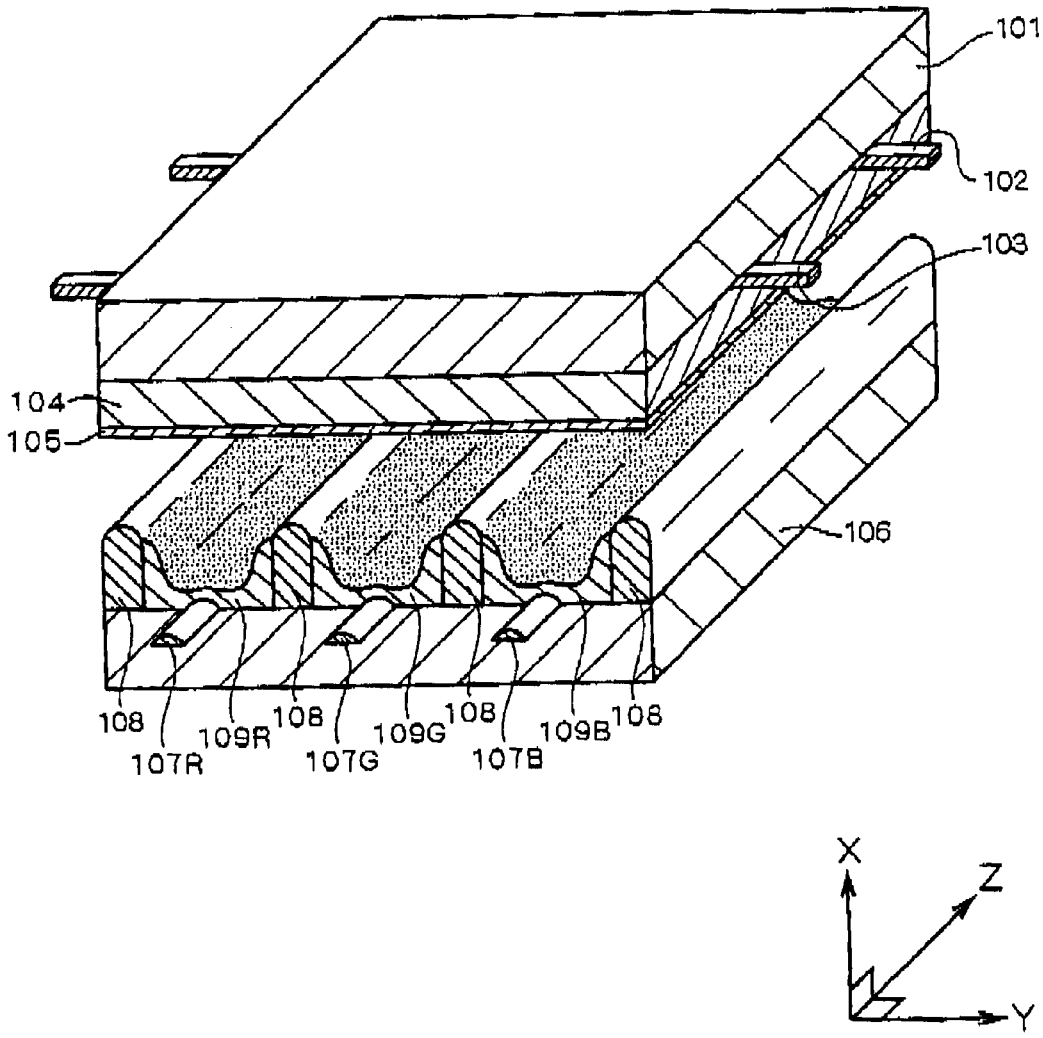
FIG. 13 PRIOR ART
FIG. 13 is a perspective view showing a cell structure of a PDP in the background art.

FIG. 12 is a schematic view of a configuration of a PDP in accordance with the sixth variation, showing extracted scan electrode 2, the sustain electrode 3 and the barrier ribs 8 in four adjacent discharge cells viewed from the front panel along the X direction. In portions which do not two-dimensionally overlap the frame-like electrodes 2*bb* or 3*bb* or the barrier ribs 8 as hatched in FIG. 12, phosphors having the same colors as the phosphors coated on the rear panel are formed on the protection film 5 with a predetermined thickness.

Though the bus electrodes 2*a* and 3*a* are arranged on the end portions of the transparent electrodes 2*b* and 3*b* on the side opposite to the discharge gaps in the above preferred embodiments, the bus electrodes 2*a* and 3*a* do not have to be arranged on the end portions of the transparent electrodes 2*b* and 3*b* in order to perform the function of the bus electrodes 2*a* and 3*a* to supply currents to the transparent electrodes 2*b* and 3*b,* and may be arranged on, for example, the center portions of the transparent electrodes 2*b* and 3*b*.

Further, since the present invention relates to the front panel of the PDP, a rear panel having any structure as well as that shown in FIG. 1 may be adopted. For example, a rear panel in which the distances between adjacent barrier ribs vary depending on colors as disclosed in Japanese Patent Application Laid-Open No. 10-308179 (1998) may be adopted.

Furthermore, combination of the PDP in accordance with the present invention and a well-known driving circuit for driving the PDP can constitute a plasma display device having excellent display characteristics.

While the invention has been shown and described in detail, the foregoing description is in all aspects illustrative and not restrictive. It is therefore understood that numerous modifications and variations can be devised without departing from the scope of the invention.

What is claimed is:

1. A plasma display panel comprising:

a first substrate serving as a display surface;

a second substrate opposed to said first substrate with a discharge space interposed therebetween, said discharge space having a plurality of unit discharge regions arranged in matrix;

a first electrode and a second electrode formed on a main surface of said first substrates on the side of said discharge space, being paired with each other and provided for each row of said plurality of unit discharge regions;

a third electrode formed on a main surface of said second substrate on the side of said discharge space, being provided for each column of said plurality of unit discharge regions; and phosphors of two kinds or more formed on said main surface of said second substrate covering said third electrode, having different luminescent colors, wherein said first electrode comprises:

a trunk portion extending in a first direction, which is a direction of said row; and branch portions connected to said trunk portion, being provided for said plurality of unit discharge regions, respectively, and protruding in a second direction which is a direction of said column, wherein said second electrode comprises:

a trunk portion extending in said first direction; and branch portions connected to said trunk portion of said second electrode, being provided for said plurality of unit discharge regions, respectively, and protruding in said second direction to define discharge gaps between said branch portions of said first and second electrodes, respectively, wherein the areas of said branch portions of said first electrode vary among said plurality of unit discharge regions, and wherein the areas of said branch portions of said second electrode are equal among said plurality of unit discharge regions.

2. A plasma display panel, comprising:

a first substrate serving as a display surface;

a second substrate opposed to said first substrate with a discharge space interposed therebetween, said discharge space having a plurality of unit discharge regions arranged in matrix;

a first electrode and a second electrode formed on a main surface of said first substrates on the side of said discharge space, being paired with each other and provided for each row of said plurality of unit discharge regions;

a third electrode formed on a main surface of said second substrate on the side of said discharge space, being provided for each column of said plurality of unit discharge regions; and phosphors of two kinds or more formed on said main surface of said second substrate covering said third electrode, having different luminescent colors, wherein said first electrode comprises:

a trunk portion extending in a first direction which is a direction of said row; and branch portions connected to said trunk portion, being provided for said plurality of unit discharge regions, respectively, and protruding in a second direction which is a direction of said column, wherein said second electrode comprises:

a trunk portion extending in said first direction; and branch portions connected to said trunk portion off said second electrode, being provided for said plurality of unit discharge regions, respectively, and protruding in said second direction to define discharge gaps between said branch portions of said first and second electrodes, respectively, wherein the areas of said branch portions of at least one of said first electrode and said second electrode vary among said plurality of unit discharge regions, depending on said luminescent colors, and wherein said branch portions of said first or second electrode are shaped frame-like, thereby forming apertures within said branch portions.

3. The plasma display panel according to claim 2, wherein said trunk portion of said first electrode is a metal electrode, and said trunk portion of said first electrode and said branch portions of said first electrode are formed as a unit.

4. The plasma display panel according to claim 2, wherein said trunk portion of said first or second electrode extends on an outer perimeter of said apertures formed within said branch portions.

5. A plasma display panel comprising:

a first substrate serving as a display surface;

a second substrate opposed to said first substrate with a discharge space interposed therebetween, said discharge space having a plurality of unit discharge regions arranged in matrix;

a first electrode and a second electrode formed on a main surface of said first substrates on the side of said discharge space, being paired with each other and provided for each row of said plurality of unit discharge regions;

a third electrode formed on a main surface of said second substrate on the side of said discharge space, being provided for each column of said plurality of unit discharge regions; and phosphors of two kinds or more formed on said main surface of said second substrate covering said third electrode, having different luminescent colors, wherein said first electrode comprises:

a trunk portion extending in a first direction, which is a direction of said row; and branch portions connected to said trunk portion, being provided for said plurality of unit discharge regions, respectively, and protruding in a second direction which is a direction of said column, wherein said second electrode comprises:

a trunk portion extending in said first direction; and branch portions connected to said trunk portion of said second electrode, being provided for said plurality of unit discharge regions, respectively, and protruding in said second direction to define discharge gaps between said branch portions of said first and second electrodes, respectively, wherein the areas of said branch portions of at least one of said first electrode and said second electrode vary among said plurality of unit discharge regions, depending on said luminescent colors, wherein a dielectric layer formed on said main surface of said first substrate covering said first electrode and said second electrode, and wherein said phosphors are also formed on a surface of said dielectric layer in portions which do not overlap neither said branch portions of said first electrode nor said branch portions of said second electrode in plan view.

6. A plasma display panel comprising:

a first substrate serving as a display surface;

a second substrate opposed to said first substrate with a discharge space interposed therebetween, said discharge space having a plurality of unit discharge regions arranged in matrix;

a first electrode and a second electrode formed on a main surface of said first substrate on the side of said discharge space, being paired with each other and provided for each row of said plurality of unit discharge regions;

a third electrode formed on a main surface of said second substrate on the side of said discharge space, being provided for each column of said plurality of unit discharge regions; and phosphors of two kinds or more formed on said main surface of said second substrate covering said third electrode, having different luminescent colors, wherein said first electrode comprises:

a trunk portion extending in a first direction which is a direction of said row; and branch portions connected to said trunk portion, being provided for said plurality of unit discharge regions, respectively, and protruding in a second direction which is a direction of said column, wherein said second electrode comprises:

a trunk portion extending in said first direction; and branch portions connected to said trunk portion of said second electrode, being provided for said plurality of unit discharge regions, respectively, and protruding in said second direction to define discharge gaps between said branch portions of said first and second electrode, respectively;

wherein the spacings of said discharge gaps in said second direction vary among said plurality of unit discharge regions, depending on said luminescent colors;

wherein a dielectric layer formed on said main surface of said first substrate covering said first electrode and said second electrode, and wherein said phosphors are also formed on a surface of said dielectric layer in portions which do not overlap neither said branch portions of said first electrode nor said branch portions of said second electrode in plan view.

7. A plasma display device, comprising:

said plasma display panel as defined in claim 1; and a driving circuit for driving said plasma display panel.

8. A plasma display device, comprising:

said plasma display panel as defined in claim 2; and a driving circuit for driving said plasma display panel.

9. A plasma display device, comprising;

said plasma display panel as defined in claim 5; and a driving circuit for driving said plasma display panel.

10. A plasma display device, comprising:

said plasma display panel as defined in claim 6; and a driving circuit for driving said plasma display panel.

* * * * *